US009195177B2

(12) United States Patent
Miyazawa et al.

(10) Patent No.: US 9,195,177 B2
(45) Date of Patent: Nov. 24, 2015

(54) BELT DRIVING DEVICE AND IMAGE FORMING APPARATUS

(71) Applicant: CANON KABUSHIKI KAISHA, Tokyo (JP)

(72) Inventors: Toru Miyazawa, Kawasaki (JP); Takaaki Aoyagi, Kawasaki (JP); Yuri Mori, Tokyo (JP); Hisatoshi Baba, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/306,630

(22) Filed: Jun. 17, 2014

(65) Prior Publication Data

US 2014/0369721 A1 Dec. 18, 2014

(30) Foreign Application Priority Data

Jun. 18, 2013 (JP) ..... 2013-127991

(51) Int. Cl.
*G03G 15/01* (2006.01)
*G03G 15/16* (2006.01)

(52) U.S. Cl.
CPC .. *G03G 15/1615* (2013.01); *G03G 2215/00143* (2013.01); *G03G 2215/00156* (2013.01)

(58) Field of Classification Search
CPC ..... G03G 15/1615; G03G 2215/00143; G03G 2215/00156
USPC ..... 399/302, 303
See application file for complete search history.

(56) References Cited

U.S. PATENT DOCUMENTS

| | | | | |
|---|---|---|---|---|
| 6,321,052 | B1 * | 11/2001 | Yamashina et al. | 399/165 |
| 2009/0145729 | A1 * | 6/2009 | Enomoto | 198/807 |
| 2009/0162098 | A1 * | 6/2009 | Shirakata | 399/165 |
| 2010/0189475 | A1 * | 7/2010 | Atwood et al. | 399/302 |
| 2011/0200343 | A1 * | 8/2011 | Matsumoto et al. | 399/31 |
| 2011/0206392 | A1 * | 8/2011 | Hiratsuka et al. | 399/31 |
| 2011/0217090 | A1 * | 9/2011 | Yamamoto et al. | 399/302 |
| 2012/0213559 | A1 * | 8/2012 | Krucinski | 399/302 |
| 2012/0328337 | A1 * | 12/2012 | Hiratsuka et al. | 399/302 |

* cited by examiner

*Primary Examiner* — David Bolduc
(74) *Attorney, Agent, or Firm* — Fitzpatrick, Cella, Harper & Scinto

(57) ABSTRACT

A belt driving device includes first and second steering rollers to stretch an endless belt, first and second pivoting mechanisms, and first and second detecting members to detect a position of the belt A first setting portion sets first and second pivoting instruction values through which the first and second steering rollers are pivoted in the same direction, and a second setting portion sets third and fourth pivoting instruction values through which the first and second steering rollers are pivoted in the opposite directions. A controller pivots the first steering roller by the first pivoting mechanism on the basis of an addition value of the first pivoting instruction value and the third pivoting instruction value, and pivots the second steering roller by the second pivoting mechanism on the basis of an addition value of the second pivoting instruction value and the fourth pivoting instruction value.

8 Claims, 14 Drawing Sheets

(a)

(b)

(c)

(a)

(b)

(a)

(b)

BELT DRIVING DEVICE AND IMAGE FORMING APPARATUS

FIELD OF THE INVENTION AND RELATED ART

The present invention relates to a belt driving device capable of executing control for compensating for the lateral deviation (shift) and angular deviation (inclination) of its endless belt. It relates to also an image forming apparatus employing a belt driving device.

Some electrophotographic image forming apparatuses employ an endless belt (which hereafter may be referred to simply as "belt") for transferring a toner image on a photosensitive member onto recording medium. For example, some electrophotographic image forming apparatuses employ an intermediary transferring member and/or a transfer medium bearing member, which is in the form of an endless belt. An intermediary transferring member temporarily carries a toner image when the toner image is transferred from a photosensitive member onto the intermediary transferring member. A transfer medium bearing member bears and conveys a sheet of transfer medium, onto which a toner image is transferred from an intermediary transferring member or a photosensitive member.

It has become possible to improve an image forming apparatus employing an intermediary transferring member and/or transfer medium bearing member, in various functions. For example, in the case of an image forming apparatus, the intermediary transferring member of which is a belt, multiple monochromatic toner images, different in color, are layered on the belt. Therefore, it enjoys a few advantages. For example, it is unlikely to be affected by the changes in the electrical resistance of transfer medium, which are attributable to changes in humidity or the like. However, it suffers from a problem peculiar to an image forming apparatus which employs a belt. More specifically, it suffers the problem that while its belt is driven, the belt changes its position in terms of the widthwise direction of the belt (which hereafter may be referred to as "lateral belt shifting" or "lateral belt deviation"), and/or the problem that, in terms of the widthwise direction of the belt, the upstream and downstream ends of the belt become different in position, that is, the belt becomes inclined, oblique or angled relative to the normal transfer medium conveyance direction (which may be referred to as "angular belt deviation"). If the lateral belt deviation is excessive, that is, if the belt laterally shifts excessively in the frontward or rearward direction, it is possible that the belt will be damaged. Further, if the belt, in particular, the belt of a full-color image forming apparatus, becomes angled relative to the normal transfer medium conveyance direction, it is possible that the apparatus will output full-color images which suffer from color deviation.

The phenomenon that while a belt is driven, it laterally deviates and/or it becomes angled relative to the normal transfer medium conveyance direction is sometimes attributable to the belt driving mechanism and/or the mechanical accuracy of the belt itself. Further, it is sometimes attributable to the changes in belt properties, various external forces to which the belt is subjected, for example, the vibrations which occur to the belt the moment a sheet of transfer medium is transferred onto the belt (as a transfer medium bearing member), from a transfer medium delivery mechanism. Therefore, it is desired that a belt driving device is equipped with a means for preventing the occurrence of the lateral belt deviation, and/or angular belt deviation, and a means for compensating for the lateral belt deviation and angular belt deviation as they occur.

Some of the means for compensating for the lateral belt deviation and angular belt deviation as they occur are as follows:

In the case of the belt driving device disclosed in Japanese Laid-open Patent Application 2006-76784, it is provided with two pairs of sensors for detecting the position of the belt, in terms of the widthwise direction (which hereafter may be referred to as "deviation direction" of the belt or simply as "belt position"), and a pair of belt steering rollers, which are at the upstream and downstream ends of the belt, one for one, in terms of the transfer medium conveyance direction. It is structured so that the steering rollers can be tilted in the out-of-plane direction. More specifically, the upstream steering roller is tilted in response to the information regarding the belt position, in terms of the widthwise direction of the belt, detected by the upstream and downstream sensors, whereas the downstream steering roller is tilted in response to the information regarding the belt angle, relative to the normal recording medium conveyance direction, detected by the downstream pair of sensors.

In the case of the belt driving device disclosed in Japanese Laid-open Patent Application 2011-170081, the downstream steering roller is tilted in the out-of-plane direction, in response to the information regarding the belt position in terms of the widthwise direction of the belt, and the tension roller, which is on the upstream side, is displaced in the thrust direction of the roller, in response to the information regarding the belt angle, relative to the normal transfer medium conveyance direction, or the upstream steering roller is tilted based on the information regarding the belt angle relative to the normal transfer medium conveyance direction.

However, in a case where only one steering roller is tilted in the out-of-plane direction to compensate for the angular belt deviation as disclosed in Japanese Laid-open Patent Application 2006-76784, the belt is changed in position in terms of its widthwise direction at the same time as it is changed in angle. Similarly, in a case where only one steering roller is tilted in the out-of-plane direction to compensate for the lateral belt deviation, the belt is changed in angle at the same time as it is changed in position in terms of its widthwise direction. Therefore, the operation for compensating for the angular belt deviation, and the operation for compensating for the lateral belt deviation, interfere with each other. Thus, it is difficult to quickly and precisely compensate for the lateral belt deviation and angular belt deviation.

For the reason given above, it takes a substantial length of time from when the driving of the belt is started to when the belt becomes stable in angle at a target value, and position at a target value, in terms of its widthwise direction. Therefore, it sometimes takes an unexpectedly long time from when an operator gives an image forming apparatus a command to start a printing operation to when a first sheet of transfer medium having a fixed toner image is outputted. Further, the operation for compensating for the angular belt deviation, and the operation for compensating for the lateral belt deviation, interfere with each other. Therefore, the belt driving device reduces in the level of accuracy at which the compensation is made for the angular belt deviation. Thus, it occurs sometimes that an image forming apparatus outputs images which suffer from color deviation and/or nonuniformity in color. Moreover, if an attempt is made to improve a belt driving device in its capability to compensate for the angular belt deviation, by increasing the control gain for the operation to compensate for the angular belt deviation in order to minimize an image forming apparatus in color deviation, not only does the belt change in angle, but also, the belt changes in position in terms of its widthwise direction. Therefore, the control system sometimes oscillates. In reality, therefore, control gain cannot be increased enough for the double-steering mechanism to be fully utilized in its performance. In other words, there is a limit to the conventional method for improving a belt driving device in its capability to compensate for the angular belt deviation.

Further, in a case where a belt suspending-tensioning roller is displaced in its thrust direction to compensate for the angular belt deviation as stated in Japanese Laid-open Patent Application 2011-170081, the belt angle and belt position change at the same time as stated in Japanese Laid-open Patent Application 2006-76784. Therefore, the same problem as that stated in Japanese Laid-open Patent Application 2006-76784 occurs.

Further, in a case where a steering roller is tilted in the in-plane direction to compensate for the angular deviation as disclosed in Japanese Laid-open Patent Application 2011-170081, a belt displaces in the belt conveyance direction. Thus, this method is problematic in that it has undesirable effects upon the color deviation in terms of the secondary scan direction.

SUMMARY OF THE INVENTION

According to an aspect of the present invention, there is provided a belt driving device for driving an endless belt, the belt driving device comprising a plurality of rollers configured to stretch the belt, said rollers including first and second steering rollers being provided in an upstream side and a downstream side of an image receiving surface of the belt for receiving an image, respectively, and being configured to change a position of the belt in a direction crossing with a moving direction of the belt by inclining respectively; a pivoting unit configured to pivot said first and second steering rollers, respectively; a detecting unit for detecting an inclination amount of the belt with respect to a feeding direction of the belt; and a controller configured to pivot said first and second steering rollers in the same direction by said pivoting unit on the basis of a result of detection of said detecting unit.

According to another aspect of the present invention, there is provided a belt driving device for driving an endless belt, the belt driving device comprising a plurality of rollers configured to stretch the belt, said rollers including first and second steering rollers being provided in an upstream side and a downstream side of an image receiving surface of the belt for receiving an image, respectively, and being configured to change a position of the belt in a direction crossing with a moving direction of the belt by inclining respectively; a pivoting unit configured to pivot said first and second steering rollers, respectively; a detecting unit for detecting an inclination amount of the belt with respect to a direction crossing with a feeding direction of the belt; and a controller configured to pivot said first and second steering rollers in opposite directions by said pivoting unit on the basis of a result of detection of said detecting unit.

According to a further aspect of the present invention, there is provided a belt driving device for driving an endless belt, the belt driving device comprising a plurality of rollers configured to stretch the belt, said rollers including first and second steering rollers being provided in an upstream side and a downstream side of an image receiving surface of the belt for receiving an image, respectively, and being configured to change a position of the belt in a direction crossing with a moving direction of the belt by inclining respectively; first and second pivoting mechanisms configured to pivot said first steering roller and second steering roller in accordance with respective pivoting instruction values; a first detecting member and a second detecting member configured detect a position of the belt with respect to a widthwise direction crossing with a moving direction of the belt; a first setting portion configured to set a first pivoting instruction value and a second pivoting instruction value through which said first steering roller and said second steering roller are pivoted in the same direction, respectively, on the basis of results of detections of said first detecting member and second detecting member; a second setting portion configured to set a third pivoting instruction value and a fourth pivoting instruction value through which said first steering roller and said second steering roller are pivoted in the opposite directions, respectively, on the basis of a result of detection of at least one of said first detecting member and second detecting member; and a controller configured to pivot said first steering roller by said first pivoting mechanism on the basis of an addition value of the first pivoting instruction value and the third pivoting instruction value, and configured to pivot said second steering roller by said second pivoting mechanism on the basis of an addition value of the second pivoting instruction value and the fourth pivoting instruction value.

Further features of the present invention will become apparent from the following description of exemplary embodiments (with reference to the attached drawings).

DESCRIPTION OF THE PREFERRED EMBODIMENTS

Hereinafter, belt driving devices and image forming apparatuses, which are in accordance with the present invention, are described in detail with reference to appended drawings.

Embodiment 1

1. Overall Structure and Operation of Image Forming Apparatus

Figure 1:
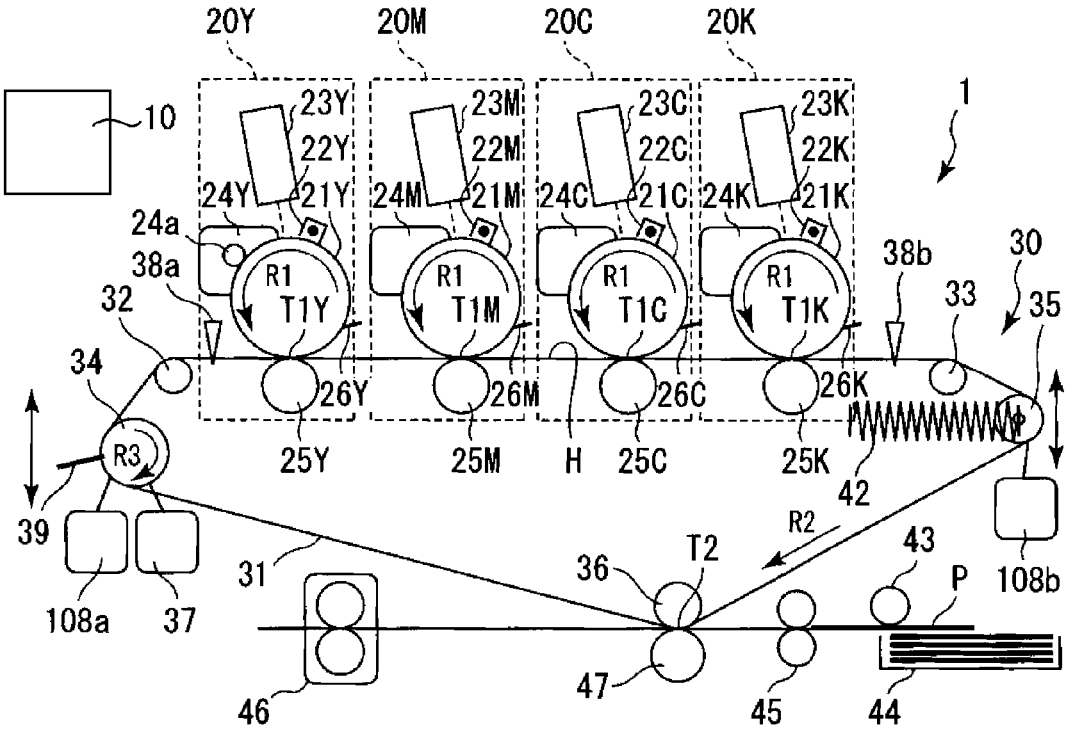
FIG. 1 is a schematic sectional view of the image forming apparatus in the first embodiment of the present invention.

FIG. 1 is a schematic sectional view of the image forming apparatus in the first embodiment of the present invention (at plane perpendicular to the belt conveyance direction, which will be described later in detail).

The image forming apparatus 1 is a full-color printer of the so-called tandem type, and also, of the so-called intermediary transfer type. That is, it has multiple image forming portions 20Y, 20M, 20C and 20K, as image forming means, which are aligned in tandem in the moving direction of the primary transfer surface H of the intermediary transfer belt 31. The image forming portions 20Y, 20M, 20C and 20K form yellow (Y), magenta (M), cyan (C) and black (K) images, respectively.

The image forming portions 20Y, 20M, 20C and 20K are practically the same in structure and operation, although they are different in the color of the toner they use. Thus, in the following description of the image forming apparatus, the suffixes Y, M, C and K which are for indicating color are not shown. That is, in terms of structural components, the four image forming portions are described together, unless they need to be differentiated.

The image forming portion 20 has a photosensitive drum 21, as an image bearing member, which is an electrophotographic photosensitive member. The photosensitive drum 21 is in the form of a drum (cylindrical). The photosensitive drum 21 is rotationally driven in the direction indicated by an arrow mark R1 in the drawing. Each image forming portion 20 has also a charging device 22 of the corona type, as a charging means, an exposing device (laser scanner) 23 as an exposing means, a developing device 24 as a developing means, a primary transfer roller 25 as a primary transferring means (primary transferring member in form of roller), and a drum cleaning device 26 as a photosensitive member cleaning means, which are disposed in the adjacencies of the peripheral surface of the photosensitive drum 21, in the listed order, in the rotational direction of the photosensitive drum 21.

The photosensitive drum 21 has a negatively chargeable photosensitive layer as the surface layer. It is rotationally driven at a process speed of roughly 300 mm/sec, in the direction indicated by the arrow mark R1 in the drawing.

The charging device 22 of the corona type negatively charges the peripheral surface of the photosensitive drum 21 to a preset potential level VD (pre-exposure potential level), by irradiating charged particles attributable to corona discharge.

The exposing device 23 writes an electrostatic image (electrostatic latent image) on the peripheral surface of the photosensitive drum 21, by scanning the charged portion of the photosensitive drum of the photosensitive drum 21, with the beam of laser light it emits while modulating (turning on or off) the beam, according to the image formation data obtaining by separating the image to be formed, into monochromatic images of the primary colors.

The developing device 24 charges the two-component developer, that is, the developer made up of nonmagnetic toner particles (toner) and magnetic carrier particles (carrier), makes its development sleeve 24*a*, as a developer bearing member, bear the charged developer, and conveys the charged developer to the area where the development sleeve 24*a* opposes the photosensitive drum 21. To the development sleeve 24*a*, an oscillatory voltage, which is a combination of DC and AC voltages, is applied as development bias. Thus, the negatively charged toner is made to transfer onto the exposed points (portions) of the peripheral surface of the photosensitive drum 21, which are positive in polarity relative to the negatively charged toner. Consequently, the electrostatic latent image is developed in reverse.

The primary transfer roller 25 presses the intermediary transfer belt 31, from the inward side of the intermediary transfer belt 31, upon the peripheral surface of the photosensitive drum 21, forming thereby a primary transferring portion (nip) T1 between the photosensitive drum 21 and intermediary transfer belt 31. In the primary transferring portion T1, the toner image on the peripheral surface of the photosensitive drum 21 is transferred (primary transfer) onto the intermediary transfer belt 31. More specifically, in order to transfer the toner image on the photosensitive drum 21 onto the intermediary transfer belt 31, positive DC voltage, which is opposite in polarity from the toner (normal toner charge polarity) is applied as primary transfer bias to the primary transfer roller 25.

The drum cleaning device 26 scrapes the peripheral surface of the photosensitive drum 21 with its cleaning blade. Thus, the toner (primary transfer residual toner) remaining on the peripheral surface of the photosensitive drum 21 after the primary transfer is removed from the photosensitive drum 21, and is recovered.

A belt unit 30, as a belt driving device, is positioned so that it opposes the photosensitive drum 21 of each image forming portion 20. Although the structure and operation of the belt unit 30 will be described later in detail, the belt unit 30 has the intermediary transfer belt 31 suspended, and kept tensioned, by multiple rollers. As a first steering roller 34, which will be described later, is rotationally driven, the intermediary transfer belt 31 is circularly moved in the direction indicated by the arrow mark R2 in the drawing. Further, each image forming portion 20 is provided with a primary transfer roller 25, which is positioned on the inward side of the loop (belt loop) which the intermediary transfer belt 31 forms, so that it opposes the photosensitive drum 21. Further, there is a secondary transfer roller 47 as the secondary transferring member, on the outward side of the loop which the intermediary transfer belt 31 forms. The secondary transfer roller 47 is positioned so that it opposes a belt-backing roller 36, which also will be described later. The secondary transfer roller 47 is placed in contact with the portion of the intermediary transfer belt 31, which is supported by the belt-backing roller 36 from within the belt loop, forming thereby the secondary transferring portion (nip) T2. Further, there is a belt cleaning device 39 as the means for cleaning the intermediary transfer belt 31, on the outward side of the belt loop, and is positioned so that it opposes the first steering roller 34, which will be described later.

When the image forming apparatus 1 is used for forming a full-color image, first, a yellow toner image is formed on the photosensitive drum 21Y in the image forming portion 20Y, and is transferred (primary transfer) onto the intermediary transfer belt 31. In the image forming portion 20M for magenta color, a magenta toner image is formed on the photosensitive drum 21M, and is transferred (primary transfer) in layers on the yellow toner image on the intermediary transfer belt 31. In the image forming portions 20C and 20K for cyan and black colors, respectively, cyan and black toner images are formed on the photosensitive drum 21C and 21K, respectively, and are transferred (primary transfer) in layers onto the intermediary transfer belt 31. After being transferred onto the intermediary transfer belt 31, the multiple (four) toner images, different in color, are conveyed to the secondary transferring portion T2, and transferred together (secondary transfer) onto a sheet P of transfer medium such as recording paper.

Sheets P of transfer medium in a transfer medium cassette 44 are pulled out of the transfer medium cassette 44 while being separated one by one by a separation roller 43, and then, each sheet P of transfer medium is conveyed to a pair of registration rollers 45. The registration rollers 45 catch each sheet P of transfer medium, and keeps the sheet P on standby, while remaining stationary. Then, they send the sheet P to the secondary transfer portion T2, with such a timing that the sheet P arrives at the secondary transferring portion T2 at the same time as the toner images on the intermediary transfer belt 31. In the secondary transferring portion T2, the sheet P is sandwiched by the intermediary transfer belt 31 and secondary transfer roller 47, being layered upon the toner images on the intermediary transfer belt 31. Thus, while the sheet P is conveyed through the secondary transferring portion T2, the toner images on the intermediary transfer belt 31 are transferred (secondary transfer) onto the sheet P of transfer medium. During this process, DC voltage which is positive in polarity, being therefore opposite in polarity from the polarity of toner (normal polarity of charged toner) during development, is applied as the second transfer bias to the secondary transfer roller 47.

The toner (secondary transfer residual toner) which was not transferred onto the sheet P of transfer medium, and therefore, are remaining on the peripheral surface of the photosensitive drum 21 after the secondary transfer, is removed from the intermediary transfer belt 31 by the belt cleaning device 39, and is recovered.

After the transfer of the full-color toner image, made up of four monochromatic images, different in color, onto the sheet P of transfer medium, the sheet P is separated from the intermediary transfer belt 31 with the utilization of the curvature of the intermediary transfer belt 31, and then, is introduced into a fixing device 46 as a fixing means. The fixing device 46 fixes the full-color toner image to the surface of the sheet P by applying heat and pressure to the sheet P. After the fixation of the toner image to the sheet P, the sheet P is discharged from the main assembly of the image forming apparatus 1.

In the case of the intermediary transfer system which indirectly transfers a toner image onto a sheet P of transfer medium by way of the intermediary transfer belt 31, it is on the intermediary transfer belt 31 that multiple monochromatic toner images, different in color, are layered. Therefore, it is unlikely to be affected by the changes in the electrical resistance of transfer medium, which is attributable to changes in humidity, for example. Further, in comparison to the direct transfer system which directly and sequentially transfers multiple monochromatic toner images, different in color, onto a sheet P of transfer medium, the intermediary transfer system is easier to control in the condition under which toner images are transferred when a full-color image is formed. Further, an image forming apparatus which employs the intermediary transfer system is simpler in the transfer medium conveyance system, and therefore, less likely to suffer from sheet jam.

2. Belt Steering System

In order to form a high quality full-color image, in particular, a full-color image which does not suffer from color deviation, with the use of an image forming apparatus 1 structured so that it is on the intermediary transfer belt 31 that multiple toner images are layered, it is important to control the belt unit of the image forming apparatus 1 so that the belt unit becomes as close as zero in the angular deviation of the belt, for the following reason. That is, if the belt is angled relative to the normal transfer medium conveyance direction, the image forming portions 20, different in the color of the image they form, become different in the position of their primary transferring portion T1, in terms of the direction perpendicular to the normal transfer medium conveyance direction. This results in the formation of a full-color image which suffers from color deviation. Further, if the intermediary transfer belt 31 laterally deviates all the way (virtually completely deviates in its widthwise direction, that is, either rearward or forward), it is possible that the intermediary transfer belt 31 will be damaged. In order to prevent this problem, it is important to keep the intermediary transfer belt 31 positioned so that the intermediary transfer belt 31 is prevented from laterally deviating all the way.

However, as an endless belt suspended, and kept tensioned, by multiple rollers, is circularly driven, the belt is subjected to such a force that pushes the belt in the direction parallel to the axial line of each roller (widthwise direction of belt). Therefore, the belt displaces in the direction parallel to the axial line of the roller until the above-described force disappears. This phenomenon is attributable to several factors, for example, errors in belt dimension, errors in the diameter of each of belt suspending rollers, misalignment of the rollers, which occurred during the assembly of the belt unit, etc.

Therefore, in the case of the image forming apparatus 1 in this embodiment, a belt steering system is employed to ensure that when the belt is circularly driven, it remains stable in its path. Generally speaking, the belt steering system is structured as follows: That is, the belt unit is structured so that at least one of the rollers by which the belt is suspended is usable as a steering roller, that is, a roller which can be tilted. Further, the position to which the belt has laterally moved, and the angular deviation of the belt, are detected. Then, based on this information, the steering roller is controlled in the direction in which it is to be tilted, and the amount (angle) by which it is to be tilted, in order to compensate for the lateral deviation of the belt and angular deviation of the belt. In particular, in the case of the image forming apparatus 1 in this embodiment, the two steering rollers are controlled in angle in order to compensate for two factors, that is, the lateral deviation of its belt, and the angular deviation of the belt.

3. General Structure of Belt Unit

Next, the belt unit 30, as a belt driving device, in this embodiment, which is equipped with a belt steering system is described.

Regarding the orientation of the image forming apparatus 1 and/or its structural components, the front side is equivalent to the front side of the sheet of paper on which FIG. 1 is drawn. The rear side is the opposite side of the front side. Further, the direction which is parallel to the line connecting the front and rear sides is the rearward direction. The rearward direction is such a direction that is perpendicular to the belt conveyance direction (roughly parallel to axial line of belt supporting roller).

The belt unit 30 has: the intermediary transfer belt 31 which is an endless belt (belt, belt-like member); and multiple belt suspending rollers (belt supporting rollers), as a belt suspending-tensioning members, which are means for rotatably supporting the intermediary transfer belt 31. In this embodiment, the belt unit 30 has the following multiple rollers which support, and keep tensioned, the intermediary transfer belt 31. More specifically, the belt unit 30 has: the first steering roller (belt driving steering roller) 34, which functions as both a belt driving roller, and belt steering roller; the second steering roller 35; the first idler roller 32; the second idler roller 33; and the belt-backing roller 36. Further, the belt unit 30 has also the primary transfer rollers 25Y, 25M, 25C and 25K, which are on the inward side of the loop (belt loop) which the intermediary transfer belt 31 forms, as described previously. In this embodiment, each of the primary transfer rollers 25Y, 25M, 25C and 25K also makes up a part of the combination of the multiple belt suspending rollers. The intermediary transfer belt 31 is rotatably supported and kept tensioned, by these belt suspending rollers.

The first steering roller 34 is in connection to the belt-driving motor 37 as a belt driving means. Thus, as the first steering roller 34 is rotationally driven in the direction indicated by an arrow mark R3 in the drawing by the belt-driving motor 37, the intermediary transfer belt 31 is circularly moved in the direction indicated by the arrow mark R2 in the drawing.

The second steering roller 35 is kept pressed by a pair of springs 42, outward of the intermediary transfer belt 31, from within the belt loop. It is attached so that it can be changed in position. Thus, the second steering roller 35 provides the intermediary transfer belt with a preset amount of tension.

The first and second idler rollers 32 and 33 prevent the intermediary transfer belt 31 from being changed in its angle (inclination), relative to a preset plane, by the tilting of the first steering roller 34 and second steering roller 35, in order to keep the primary transfer surface H parallel to the preset plane.

The first idler roller 32 is positioned upstream of the primary transfer roller 25Y (that is, primary transferring portion T1) of the image forming portion 20Y, which is the most upstream image forming portion 20, in terms of the belt conveyance direction. The second idler roller 33 is positioned downstream of the primary transfer roller 20K of the image forming portion 20K, which is the most downstream image forming portion 20, in terms of the belt conveyance direction. The first steering roller 34 and second steering roller 35, which are belt suspending rollers adjustable in alignment, are on the upstream and downstream sides, respectively, of the primary transfer surface (image receiving portion) H of the intermediary transfer belt 31.

Although detailed description will be given later, the belt unit 30 is structured so that the lateral deviation of the intermediary transfer belt 31, and the angular deviation of the intermediary transfer belt 31, can be controlled by optionally changing the first steering roller 34 and second steering roller 35 in alignment. "Alignment" means the angle of the rotational axis of a steering roller relative to the direction perpendicular to the belt conveyance direction, that is, the out-of-plane angular deviation. "Lateral deviation" of the intermediary transfer belt 31 means the change (deviation) in the position of the intermediary transfer belt 31 in terms of its widthwise direction. Further, "Angular deviation" of the intermediary transfer belt 31 is equivalent to the difference in position between the upstream and downstream ends of the intermediary transfer belt 31, in terms of the widthwise direction of the belt 31. It sometimes is referred to as "belt inclination" or "belt skew".

Next, the means employed by the belt steering system in this embodiment to detect the position of the intermediary transfer belt 31 in terms of its widthwise direction, and the angle of the intermediary transfer belt 31 relative to the normal belt conveyance direction, is described.

The belt unit 30 is provided with a pair of sensors (first and second sensors 38*a* and 38*b*), which are disposed so that their position corresponds to the first transfer surface H of the intermediary transfer belt 31, with the presence of a preset distance between the two sensors 38*a* and 38*b* in terms of the belt conveyance direction. The first and second sensors 38*a* and 38*b* are detecting means for detecting the lateral deviation of the intermediary transfer belt 31, and/or angular deviation of the intermediary transfer belt 31. That is, they make up an example of means for detecting the position (to which intermediary transfer belt 31 has deviated) of the intermediary transfer belt 31 in terms of its widthwise (direction of deviation) direction.

The first sensor 38*a* is disposed in the adjacencies of the first idler roller 32 which is on the upstream side of the primary transfer surface H. The second sensor 38*b* is disposed in the adjacencies of the second idler roller 33 which is on the downstream side of the primary transfer surface H. To describe in more detail, the first sensor 38*a* is between the first steering roller 34 and the primary transfer roller 25Y of the most upstream image forming portion 20Y which is the closest of the four primary transfer rollers 25 to the first steering roller 34. It is in the adjacencies (downstream side) of the first idler roller 32. Further, the second sensor 38*b* is between the first steering roller 34 and the primary transfer roller 25K of the most downstream image forming portion 20K which is the closest of the four image forming portions 20 to the second steering roller 35. It is in the adjacencies (upstream side) of the second idler roller 33.

In this embodiment, the first sensor 38*a* and second sensor 38*b* are principally the same. They are edge sensors for detecting one of the lateral edges of the intermediary transfer belt 31. Here, the second sensor 38*b*, which is on the downstream side of the primary transfer surface H, is described further in detail.

Figure 2:
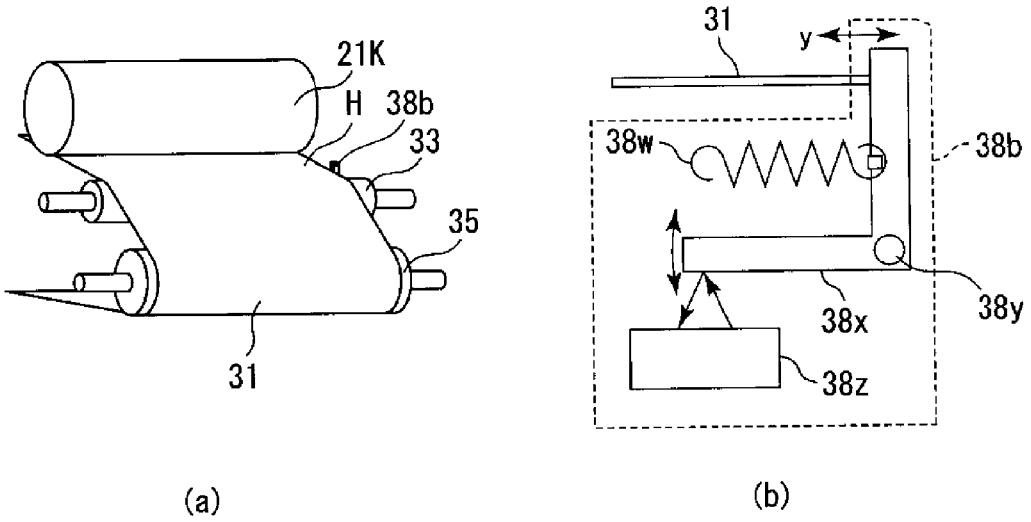
FIGS. 2(*a*) and 2(*b*) are schematic drawings for describing the belt edge sensors in the first embodiment.

FIG. 2(*a*) is a schematic drawing which shows the appearance of the downstream portion of the belt unit 30 where the second sensor 38*b* is present. The second sensor 38*b* can detect the position of the intermediary transfer belt 31 in terms of the widthwise direction of the intermediary transfer belt 31, at its location (detection point).

FIG. 2(*b*) is a schematic sectional view of the second sensor 38*b*. The second sensor 38*b* is structured so that one end of its contact 38*x* is kept pressed upon the one (rear) of the lateral edges of the intermediary transfer belt 31, by the tension of the spring 38*w*. In this embodiment, the contact pressure generated between the contact 38*x* and the lateral edge of the intermediary transfer belt 31 by the spring 38*w* is properly set, that is, large enough to keep the contact 38*x* in contact with the lateral edge of the intermediary transfer belt 31, but not large enough to deform the intermediary transfer belt 31. Further, the contact 38*x* is rotatably supported by a shaft 38*y*, at its center portion. Further, a displacement sensor 38*z*, which is a photosensor of the reflection type, is positioned so that it opposes the other end of the contact 38*x*. Thus, the changes in the position of the intermediary transfer belt 31 in terms of its widthwise direction (indicated by arrow mark y in drawing) is converted into the movement (oscillatory movement) of the contact 38*x* which is kept pressed upon the lateral edge of the intermediary transfer belt 31. More specifically, the output level of the displacement sensor 38*z* changes in response to the movement (displacement) of the contact 38*x*. Therefore, the position of the intermediary transfer belt 31 in terms of its widthwise direction can be continuously determined based on the output of the sensor 38*z*.

Generally speaking, here, the contour of the edge of the intermediary transfer belt 31 is not really straight, because of what occurred during the manufacturing of the intermediary transfer belt 31, the material for the intermediary transfer belt 31, etc. Therefore, in the case of a system which detects the edge of the intermediary transfer belt 31 to determine the position of the intermediary transfer belt 31, the belt position in terms of its widthwise direction can be more accurately detected by making the two sensors substantially different in the belt edge detection timing by providing a substantial distance between the two sensors, or obtaining in advance the profile of the belt edge, and compensating the results of the measurement by the sensors, based on the belt edge profile.

Incidentally, the method for detecting the position of the intermediary transfer belt 31 in terms of its widthwise direction does not need to be limited to the means such as the above described one which places a sensor of the contact type along one of the lateral edges of the intermediary transfer belt 31. For example, it may be a method which reads a mark (which may be drawn or formed in advance, or formed with toner) drawn on the belt, with the use of a sensor of the non-contact type. That is, the present invention is compatible with either of the above described two means for detecting the position of the intermediary transfer belt 31 in its widthwise direction.

As the information, regarding the angular deviation of the intermediary transfer belt 31, which can be used by the belt steering system to control the angular deviation of the intermediary transfer belt 31, the value which is obtainable by the subtraction between the belt position detected by the sensor 38*a* and the belt position detected by the sensor 38*b* is used. As the information, regarding the position of the intermediary transfer belt 31, which can be used by the belt steering system to control the lateral deviation of the intermediary transfer belt 31, the average value (which may be referred to "average belt position") obtainable by averaging the information, regarding the belt position, detected by the two sensors 38*a* and 38*b*, is used.

As the information regarding the angular belt deviation which is used to control the angular deviation of the belt, the belt angle obtainable by using a single two-dimension area sensors, may be used. Further, as the information regarding the lateral deviation of the belt may be the value (output) of a single sensor, or the average value obtainable by averaging the results of the belt position detection by three or more sensors.

5. Operation to Tilt Steering Roller

Next, the operation carried out by the belt steering system to tilt the steering rollers is described.

As described above, the image forming apparatus 1 has two steering rollers, that is, the first steering roller 34 and second steering roller 35. In this embodiment, the method for tilting the first steering roller 34 and the method for tilting the second steering roller 35 are the same. Here, therefore, only the tilting of the second steering roller 35 is described.

Figure 3:
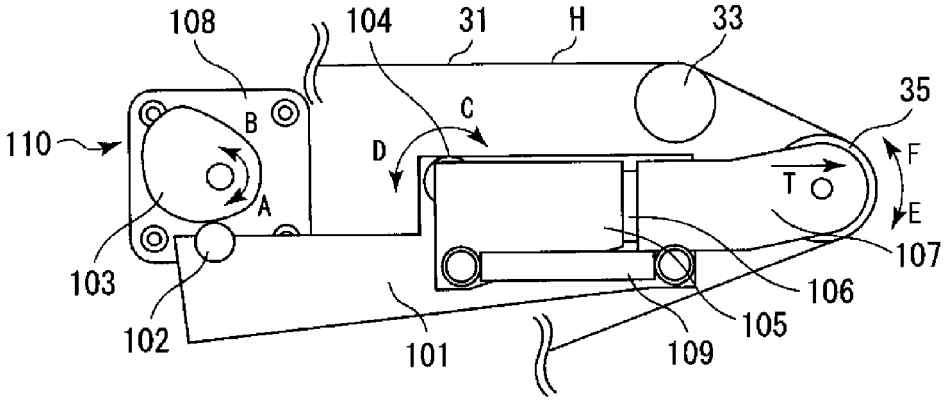
FIG. 3 is a side view of the steering roller and its adjacencies in the first embodiment.

FIG. 3 is an enlarged schematic side view (as seen from direction intersectional to belt conveyance direction) of the second steering roller 35 and its adjacencies.

First, the structure of the front end portion of the second steering roller 35 is described. The second steering roller 35 is rotatably supported by a bearing holder 107, which is fixed to the movable side of a slidable rail 106. Further, a slider 105 is fixed to the surface of the slidable rail 106, to which the bearing holder 107 is fixed. The stationary side of the slidable rail 106 is fixed to the steering arm (supporting member) 101. Further, the slider 105 is under the pressure generated in the direction indicated by an arrow mark T in FIG. 3 (outward direction of loop which intermediary transfer belt 31 forms), by a spring (pressure generating member) 109, as pressure generating means, anchored to the steering arm 101. Therefore, the slider 105 slides on the steering arm 101. Thus, the second steering roller 35 is kept pressured in the direction indicated by the arrow mark T in FIG. 3 (outward direction of loop which intermediary transfer belt 31 forms), providing thereby the intermediary transfer belt 31 with tension.

In this embodiment, the second steering roller 35 is kept pressured by the spring 109, functioning thereby to provide the intermediary transfer belt 31 with a preset amount of tension. However, the steering function and tensioning function does not need to be provided by the same component. That is, the image forming apparatus 1 may be structured so that the member for tilting the steering roller is independent from the member for providing the intermediary transfer belt 31 with tension.

In this embodiment, the front steering arm 101 is supported by a shaft (pivot) 104 so that it can be pivotally moved about the shaft 104. There is a follower 102 on the steering arm 101. The follower 102 is on the opposite side of the shaft 104 from the second steering roller 35, and is supported by a shaft. There is a cam 103, as an activating portion, which is enabled to come into contact with the follower 102. The cam 103 is rotatable by a steering motor 108 as steering roller driving means. The cam 103 and steering motor 108 make up a cam mechanism 110, as force generating means, which generates the force for tilting the steering roller 35.

As the cam 103 rotates in the direction (clockwise) indicated by an arrow mark A in FIG. 3, the lengthwise end portion of the steering arm 101, which has the follower 102, rotates in the direction (clockwise) indicated by an arrow mark C in FIG. 3, about the shaft (pivot) 104. As a result, the lengthwise end portion of the steering arm 101, by which the second steering roller 35 is held, rotationally moves in the direction indicated by an arrow mark E (downward relative to primary transfer surface H), causing thereby the steering arm 101 to change in alignment. On the other hand, as the cam 103 rotates in the direction (counterclockwise) indicated by an arrow mark B in FIG. 3, the follower 102 side of the steering arm 101 rotationally moves in the direction (counterclockwise) indicated by an arrow mark D in FIG. 3, about the shaft (pivot) 104. As a result, the second steering roller 35 side of the steering arm 101 rotationally moves in the direction (upward relative to primary transfer surface H), causing thereby the second steering roller 35 to change in alignment.

The rear end portion of the second steering roller 35 is supported roughly in the same manner as the front end portion of the second steering roller 35. On the rear end side, however, the steering arm 101 is fixed to the rear end portion of the second steering roller 35; it is not provided with the cam mechanism 110.

Figure 4:
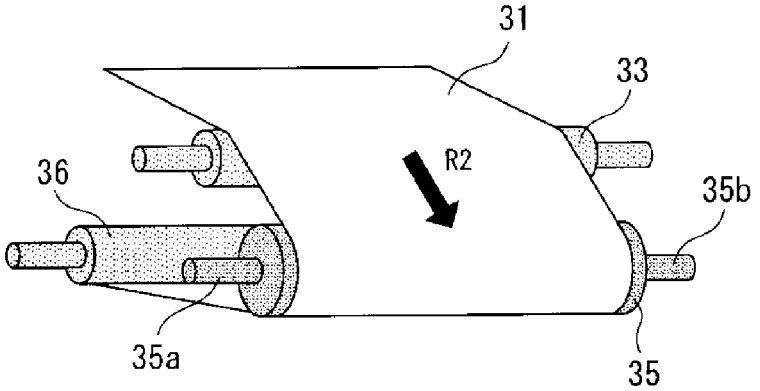
FIGS. 4(*a*), 4(*b*), and 4(*c*) are schematic perspective drawings for describing the principle based on which a belt is moved in its widthwise direction by the tilting the steering roller, in the first embodiment.
Figure 4:
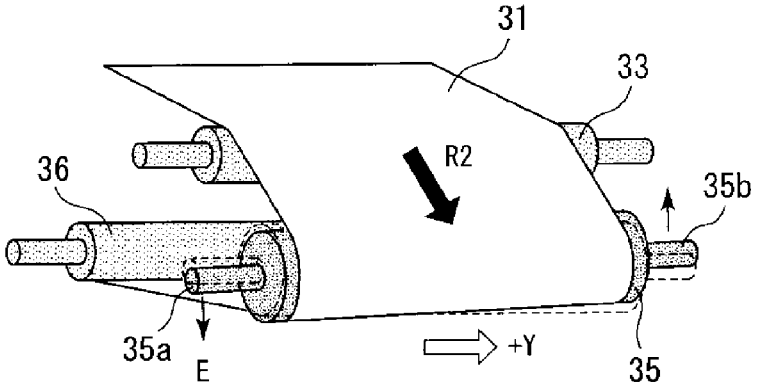
Figure 4:
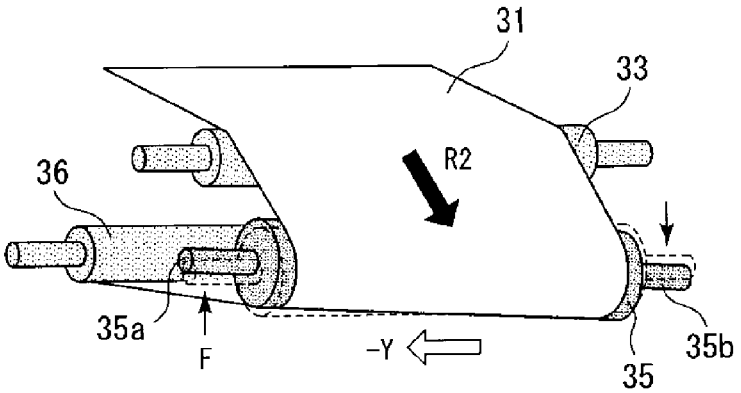

FIG. 4 is a schematic perspective view of the second steering roller 35 and its adjacencies. It is a drawing for describing the changes caused to the position of the intermediary transfer belt 31, in terms of its widthwise direction, by the tilting of the second steering roller 35.

As the second steering roller 35 is tilted as shown in FIG. 3, the intermediary transfer belt 31 is changed in position in terms of its widthwise direction as shown in FIGS. 4(*a*), 4 (*b*) and 4(*c*). More specifically, as the second steering roller 35 is changed in alignment in the direction indicated by an arrow mark E in FIG. 3, the intermediary transfer belt 31 shifts rearward, whereas the second steering roller 35 is changed in alignment in the direction indicated by an arrow mark F in FIG. 3, the intermediary transfer belt 31 shifts frontward.

In this embodiment, the rear steering arm (unshown) is fixed. However, this embodiment is not intended to limit the present invention in scope. For example, the rear side of the belt unit 30 may be provided with the same mechanism as the front side in order to make the rear steering arm pivotally movable. In such a case, it is possible to make the front and rear sides opposite in the direction in which they pivotally move, but the same in the absolute value of the amount of pivotal move, in order to make the second steering roller 35 pivotally move about the center of the second steering roller 35.

At this time, referring to FIG. 4, the basic relationship between the inclination of the second steering roller 35 and the lateral shift of the intermediary transfer belt 31 is described.

When the belt unit 30 is in the state shown in FIG. 4(*a*), the second steering roller 35 is roughly parallel to the primary transfer surface H (second idler roller 33, second steering roller 35, and belt-backing roller 36 are roughly parallel to each other). In this case, it does not occur that the intermediary transfer belt 31 shifts on the second steering roller 35 in the direction parallel to the rotational axis of the second steering roller 35.

When the belt unit 30 is in the state shown in FIGS. 4(*b*) and 4(*c*), the second steering roller 35 is tilted relative to the primary transfer surface H (that is, second steering roller 35 is tilted relative to the second idler roller 33 and belt-backing roller 36). In this case, the point at which the intermediary transfer belt 31 begins to wrap around the second steering roller 35, and the point at which the intermediary transfer belt 31 separates from the second steering roller 35, are different in terms of the direction parallel to the rotational axis of the second steering roller 35.

That is, in the state shown in FIG. 4(*b*), the second steering roller 35 tilts in such a direction that its front end 35*a* moves downward. In this case, as the intermediary transfer belt 31 is conveyed in the direction indicated by the arrow mark R2 in FIG. 4, it shifts in parallel to the direction of the rotational axis of the second steering roller 35, in the direction indicated by an arrow mark +Y in FIG. 4(*b*) (that is, toward upstream end of second steering roller 35 in terms of belt conveyance direction). In comparison, in the state shown in FIG. 4(*b*), the second steering roller 35 tilts in such a direction that its front end 35*a* moves upward. In this case, as the intermediary transfer belt 31 is conveyed in the direction indicated by the arrow mark R2 in FIG. 4, it shifts in parallel to the rotational axis of the second steering roller 35, in the direction indicated by an arrow mark −Y in FIG. 4(*c*) (that is, toward upstream end in terms of belt conveyance direction).

Figure 5:
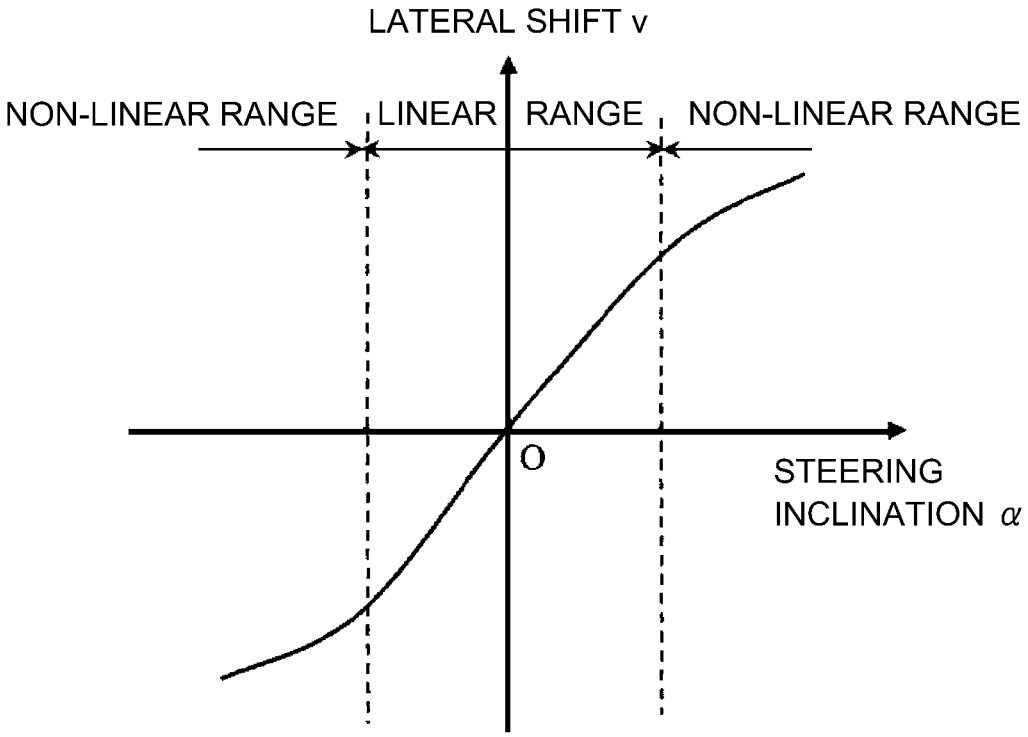
FIG. 5 is a graph which shows the relationship between the angle by which the steering roller is tilted, and the speed with which the belt moves in its widthwise direction.

The greater the second steering roller 35 in inclination, the greater the amount by which the intermediary transfer belt 31 shifts on the second steering roller 35, in the direction parallel to the rotational axis of the second steering roller 35. Therefore, the relationship between the amount a of inclination, that is, the angle of the second steering roller 35 relative to the inclination of the second steering roller 35 shown in FIG. 4(*a*), and the speed (v) at which the intermediary transfer belt 31 shifts in the direction parallel to the axial line of the steering roller 35, is as shown in FIG. 5. Referring to FIG. 5, the amount a of inclination (absolute value, strictly speaking) increases beyond a certain value, the relationship loses its linear characteristic, for the following reason. That is, as the second steering roller 35 increases in its inclination, the second steering roller 35 and intermediary transfer belt 31 begin to continuously slip relative to each other. Thus, it is within the range, shown in FIG. 5, in which the relationship is linear, that the lateral and/or angular deviation of the intermediary transfer belt 31 is controlled by the belt steering system.

The mechanism for tilting the first steering roller 34 is the same as the above described mechanism for tilting the second steering roller 35. Therefore, it will not be described in detail. In this embodiment, each component of the mechanisms for tilting the first steering roller 34 and second steering roller 35 is fixed to a frame (unshown), which supports the belt unit 30.

Figure 6:
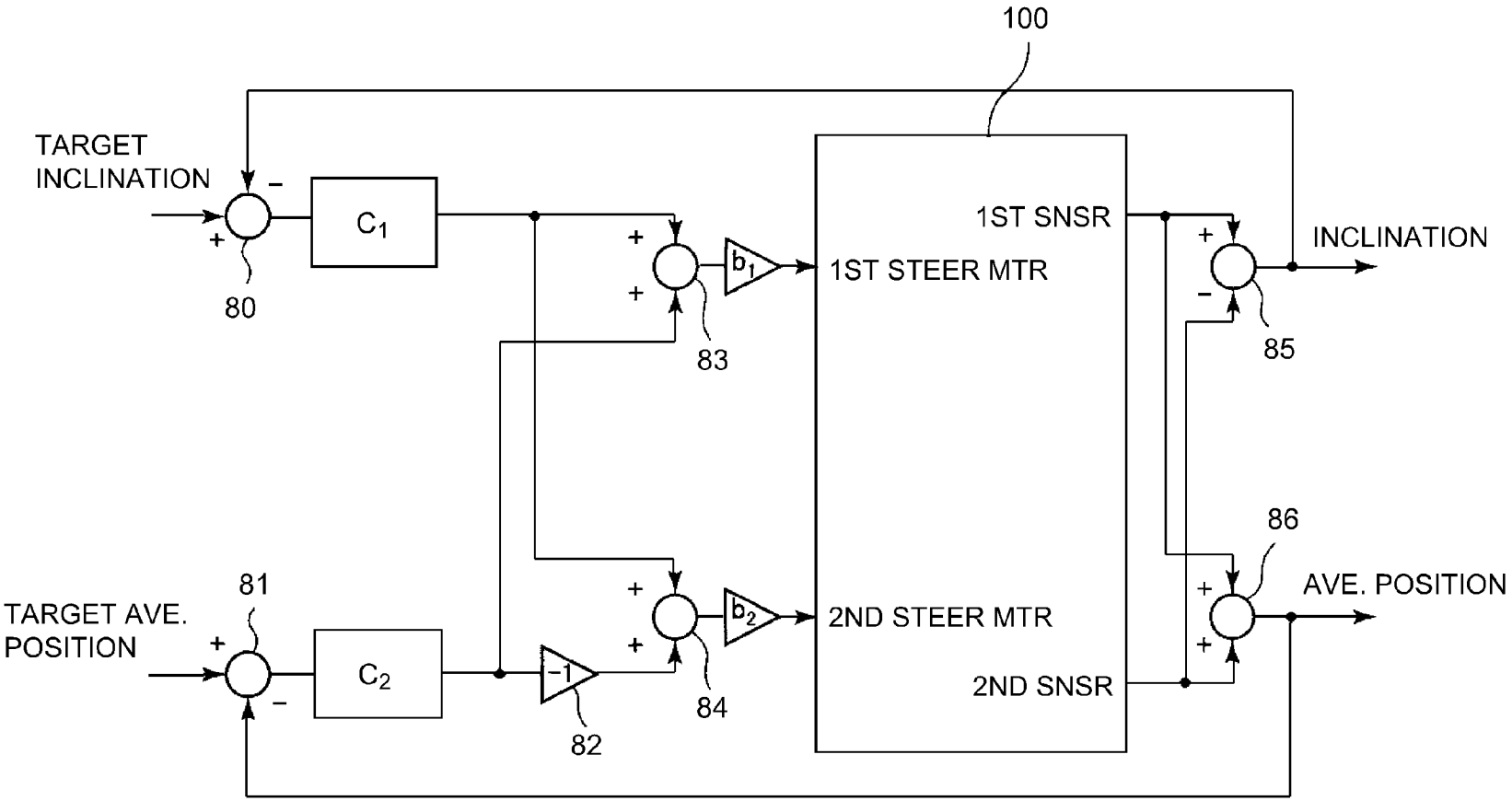
FIG. 6 is a block diagram of the steering control system, in the first embodiment.

In this embodiment, the above described mechanism for controlling the tilting of the first steering roller 34 and second steering roller 35, the first sensor 38*a* and second sensor 38*b*, etc., make up a tilt control unit 100 (FIG. 6). The above described mechanism is made up of steering arm 101, follower 102, cam 103, shaft (pivot) 104, slider 105, slide rail 106, bearing holder 107, steering motor 108, spring 109, etc. The steering motors of the mechanism for tilting the first steering roller 34 and second steering roller 35 are referred to also as the first steering motor 108*a* and second steering motor 108*b*, respectively.

6. Steering Control

Next, the control, in this embodiment, for compensating for the lateral and/or angular deviation of the intermediary transfer belt 31 is described (this control may be referred to simply as "steering control").

FIG. 6 is a block diagram of the control sequence, in this embodiment, for compensating for the angular deviation of the belt, and the lateral deviation of the belt. In this embodiment, it is possible to compensate for the angular deviation of the belt and the lateral deviation of the belt at the same time. However, in order to make it easier to understand the control of the angular deviation of the belt, and the lateral deviation of the belt, the compensation for the angular belt deviation, and the compensation for the lateral belt deviation, are separately described, with reference to a situation in which compensation needs to be made for only the angular belt deviation, and a situation in which compensation needs to be made for only the lateral belt deviation.

6-1. Compensation for Angular Belt Deviation

First, the control for a situation in which compensation has to be made for only the angular belt deviation, that is, the control required when the belt angle is deviant from the target value, but, the average belt position is on the target value, is described.

First, the belt angle is obtained by subtracting the belt position signal from the second sensor 38*b* of the tilt control unit 100, from the belt position signal from the first sensor 38*a* of the tilt control unit 100.

Next, the belt angle obtained through the above-described process is subtracted from the target value (target belt angle), to obtain the amount of the angular deviation of the belt.

Next, with the calculated amount of angular belt deviation being used as an input, the amount by which the belt needs to be corrected in angle (attitude) is computed by an angular deviation controlling device C1 made up of a PID compensator, etc., and control signals for correcting the belt in angle is outputted. The turning on or off of the outputting of the control command signal from the angular belt deviation controlling device C1 is not illustrated. However, it can be turned on or off. In this embodiment, the control algorism, such as the algorism for controlling the PID (proportion/Integration/Differentiation) control, is optional. The details of operational expressions etc., are not described here.

The control command signals outputted from the angular deviation controlling device C1 are inputted into the first and second steering motors 108*a* and 108*b*, respectively, to change the first and second steering rollers 34 and 35 in the same phase. That is, the first steering roller 34 and second steering roller 35 are simultaneously tilted in the same direction.

Figure 7:
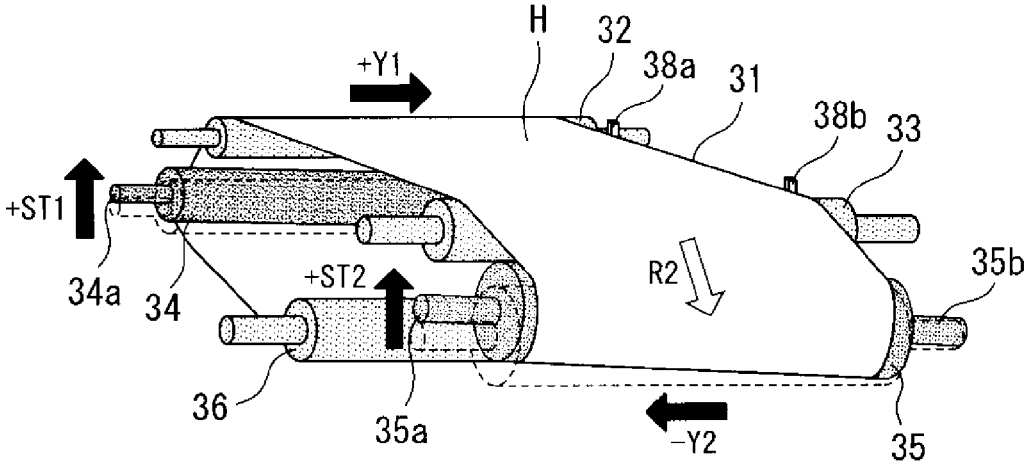
FIGS. 7(*a*) and 7(*b*) are schematic perspective views of the belt unit when two steering rollers are simultaneously tilted in the same direction.
Figure 7:
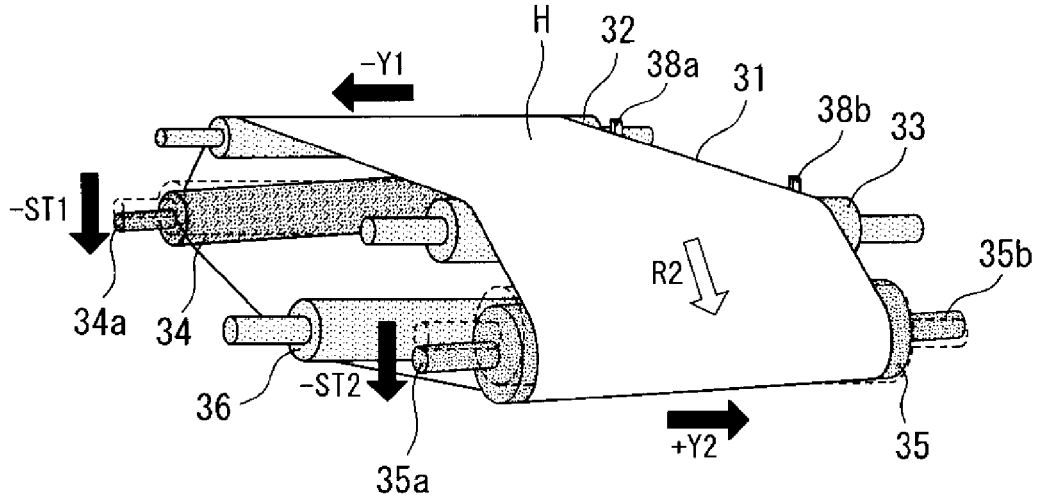

FIG. 7 is a schematic perspective view of the belt unit 30 when the first steering roller 34 and second steering roller 35 are simultaneously changed in angle in the same phase.

Here, "changing the first steering roller 34 and second steering roller 35 in angle in the same phase" means the following: Referring to FIG. 7, it is assumed here that when the primary transfer surface H, which faces upward and is roughly horizontal as it is seen from the downstream side (second steering roller 35 side) in terms of the belt conveyance direction, and from the direction roughly parallel to the belt conveyance direction, the clockwise direction is referred to as +direction, and the counterclockwise direction is referred to as −direction. Thus, it means to tilt the first steering roller 34 and second steering roller 35 in the same direction, that is, +direction, or −direction. That is, when the first steering roller 34 is tilted in the direction +ST1, the second steering roller 35 is tilted in the direction +ST2 (FIG. 7(*a*)). Similarly, when the first steering roller 34 is tilted in the direction −ST1, the second steering roller 35 is tilted in the direction −ST2 (FIG. 7(*b*)).

Referring to FIG. 7(*a*), it is assumed here that the first and second steering rollers 34 and 35 are tilted in the +direction at the same time (that is, first steering roller 34 is tilted in direction ST1, and second steering roller 35 is tilted in direction +ST2). By the way, regarding the direction of change in the position of the intermediary transfer belt 31 in terms of its widthwise direction, the rearward direction is referred to as the +direction, and the frontward direction is referred to as the −direction. In this case, the direction of the change in the position of the intermediary transfer belt 31 in terms of its widthwise direction, which occurs on the first steering roller 34, is the direction indicated by an arrow mark +Y1 (rearward direction). Also in this case, the direction of the change in the position of the intermediary transfer belt 31 in terms of its widthwise direction, which occurs on the second steering roller 35, is the direction indicated by an arrow mark −Y2 (frontward direction). In this case, therefore, the change in the position of the first steering roller 34 in terms of its widthwise direction, which occurs on the first steering roller 34 is opposite to the direction of the change in position of the intermediary transfer belt 31 in terms of its widthwise direction, which occurs on the second steering roller 35. The amount of angular belt deviation is the value obtained by subtracting the belt position signal outputted by the first sensor 38*a* from the belt position signal outputted by the second sensor 38*b*. Therefore, as the first and second steering rollers 34 and 35 are tilted, the angular belt deviation is corrected in the +direction. By the way, as the edges of the intermediary transfer belt 31 move rearward, the first and second sensors 38*a* and 38*b* displace rearward (+direction), as shown in FIG. 7(*a*), and increase in output value.

On the contrary, in a case where both the first and second steering rollers 34 and 35 are simultaneously tilted in the −direction (that is, first steering roller 34 is tilted in the direction indicated by arrow mark −ST1, and second steering roller 35 is tilted in direction indicated by arrow mark −ST2), the direction of the change in the position of the intermediary transfer belt 31 in terms of its widthwise direction, which occurs on the first steering roller 34, is the direction indicated by arrow mark −Y1 (frontward direction). On the other hand, the direction of the change in the position of the intermediary transfer belt 31 in terms of its widthwise direction, which occurs on the second steering roller 35, is the direction indicated by an arrow mark +Y2 (rearward direction). Therefore, also in this case, the direction in which the intermediary transfer belt 31 changes in position in terms of its widthwise direction, on the first steering roller 34, becomes opposite from the direction in which the intermediary transfer belt 31 changes in position in terms of is widthwise direction, on the second steering roller 35. Further, the angular belt deviation is corrected in the −direction.

Figure 8:
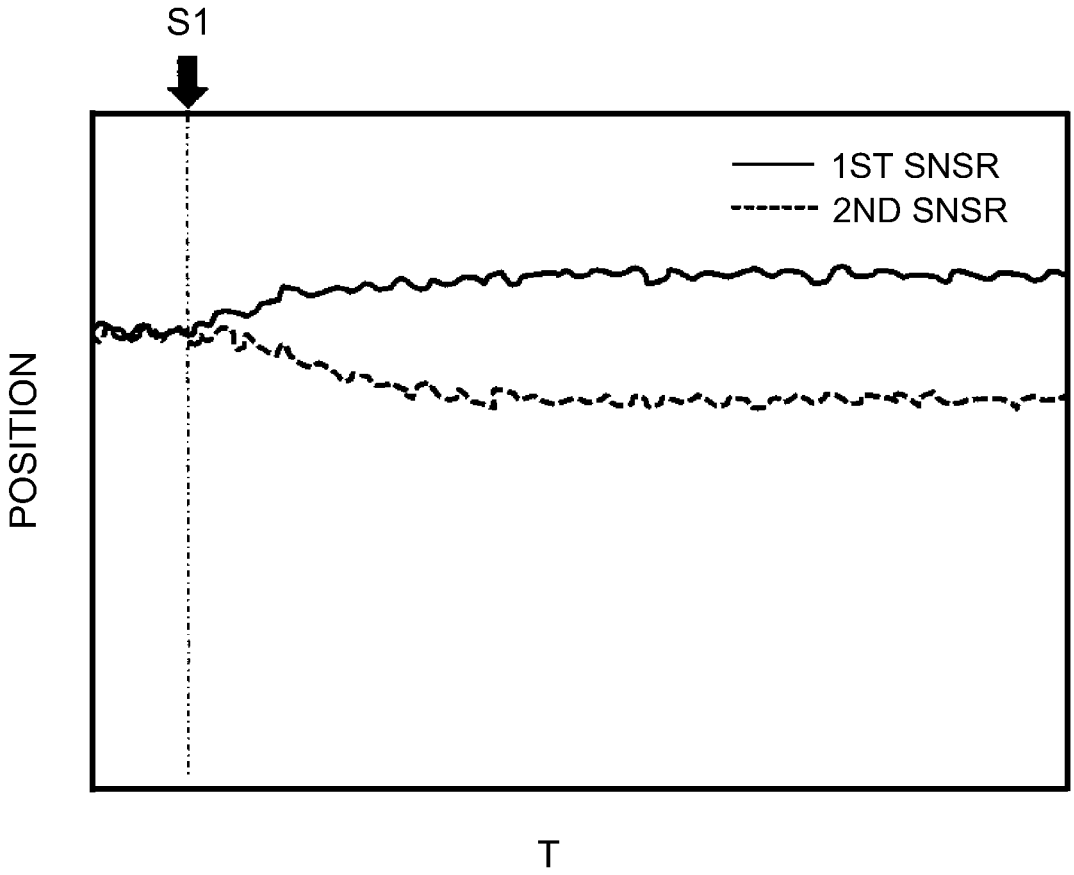
FIG. 8 is a graph which shows the changes in the position of the belt, in terms of the widthwise direction of the belt, which occurred as two steering rollers were simultaneously tilted in the same direction, and which were detected by the first and second sensors.

FIG. 8 shows the changes in the position of the intermediary transfer belt 31 in terms of its widthwise direction, which occurred when the first and second steering rollers 34 and 35 are simultaneously tilted in steps in the +direction (+ST1 and +ST2, respectively) as shown in FIG. 7(*a*). The timing with which the first and second steering roller 34 and 35 are tilted is a timing indicated by an arrow mark S1. The first sensor 38*a* displaces in the +direction, and the second sensor 38*b* displaces in the −direction. Thus, the belt angle has substantially changed in the +direction. On the other hand, the two plots are roughly horizontal after the change in the angle of the intermediary transfer belt 31 in the + or −direction, and therefore, it has virtually no effect upon the average position of the intermediary transfer belt 31, for the following reason. That is, the change in the position of the intermediary transfer belt 31, which was caused by the first steering roller 34, and that caused by the second steering roller 35, are opposite in direction, and are the same in the amount by which the intermediary transfer belt 31 was laterally moved relative to the primary transfer surface H.

This simultaneous tilting of the first and second steering rollers 34 and 35 in the same direction is utilized as an actuator for the feedback control system for compensating for the angular belt deviation by detecting the amount of angular deviation of the intermediary transfer belt 31. Thus, the angular belt deviation can be controlled without affecting the average belt position.

6-2. Compensation for Lateral Belt Deviation

Next, the control to be executed when compensation has to be made for only the average position of the intermediary transfer belt 31, that is, when the intermediary transfer belt 31 has deviated in average position from the target position, and the belt angle is on the target value, is described.

First, the belt position signal outputted by the first sensor 38*a* of the belt angle controlling unit 100, and the belt position signal outputted by the second sensor 38*b* of the belt angle controlling unit 100 are added to each other by the adder 86 to obtain the average belt position.

Next, the average amount of the lateral belt deviation is calculated by subtracting the average belt position obtained as described above, from the target value (target average position) for the average belt position.

Next, an average belt position controlling device C2 made up of a PID compensator, etc., is used to calculate the amount by which the intermediary transfer belt 31 is to be changed in position, and control command signal for average belt position compensation are outputted. The turning on or off of the outputs of the control command signal is not illustrated. However, they can be turned on or off.

The control command signal outputted from the average belt position controlling device C2 is inputted into the first steering motor 108*a* while the first steering motor 108*a* is rotated in the positive direction. Further, it is inputted into the second steering motor 108*b* after being reversed by a reversing device 82. Thus, the direction in which the first steering roller 34 is tilted becomes opposite from the direction in which the second steering roller 35 is tilted.

Figure 9:
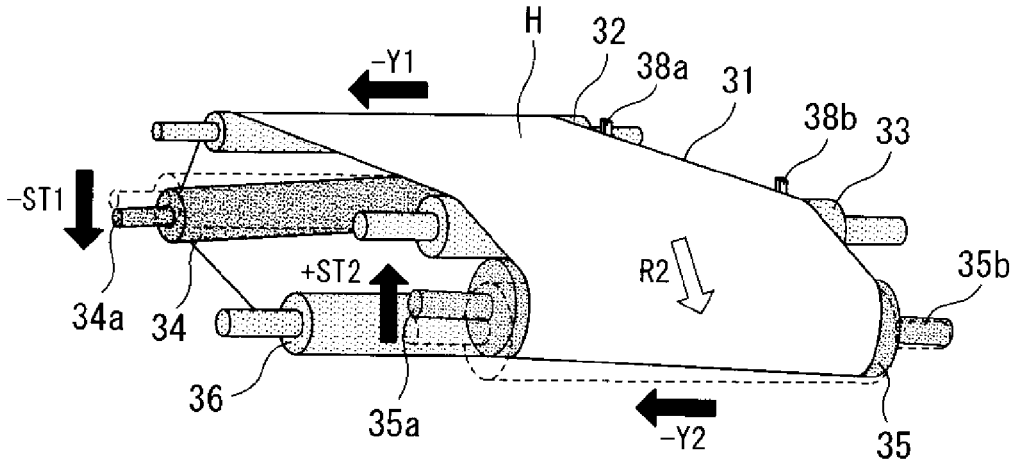
FIGS. 9(*a*) and 9(*b*) are schematic perspective views of the belt unit when the two steering rollers were simultaneously tilted in the opposite direction relative to each other.
Figure 9:
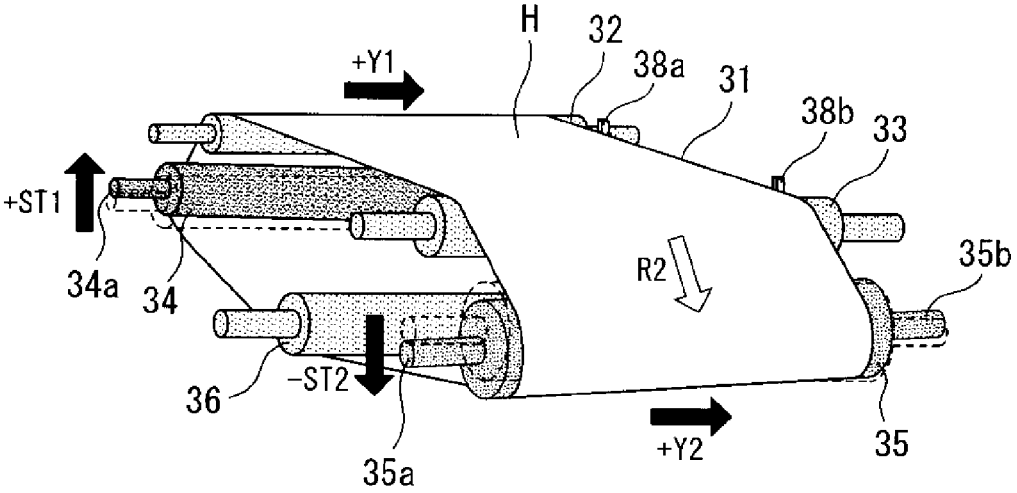

FIG. 9 is a schematic perspective view of the belt unit 30 when the first steering roller 34 and second steering roller 35 are changed in angle in the opposite direction relative to each other.

Here, "changing the first steering roller 34 and second steering roller 35 in angle in the opposite phase" means the following. It is assumed here that as the primary transfer surface H, which is roughly horizontal and faces upward, is seen from the downstream side (second steering roller 35 side) in terms of the belt conveyance direction, and also, from the direction which is roughly parallel to the belt conveyance direction, the clockwise direction is referred to as the +direction, and the counterclockwise direction is referred to as the −direction. Thus, it means to tilt the first steering roller 34 and second steering roller 35 in the opposite direction relative to each other. That is, when the first steering roller 34 is tilted in the direction indicated by an arrow mark −ST1, the second steering roller 35 is tilted in the direction indicated by an arrow mark +ST2 (FIG. 9(*a*)). Similarly, when the first steering roller 34 is tilted in the direction indicated by an arrow mark +ST1, the second steering roller 35 is tilted in the direction indicated by an arrow mark −ST2 (FIG. 9(*b*)).

Referring to FIG. 9(*a*), in a case where the first and second steering rollers 34 and 35 are tilted in the opposite direction relative to each other (that is, steering roller 35 is tilted in −ST1 direction, and second steering roller 35 is tilted in +ST2 direction), the direction of the change in the position of the intermediary transfer belt 31 in its widthwise direction, which occurs on the first steering roller 34, is the −Y1 direction (frontward direction). Further, the direction of the change in the position of the intermediary transfer belt 31 in terms of its widthwise direction, which occurs on the second steering roller 35 is also −Y2 direction (frontward direction). In this case, therefore, the direction of the change in position of the intermediary transfer belt 31 in terms of its widthwise direction, which occurs on the first steering roller 34, and that on the second steering roller 35, are the same. Also in this case, compensation is made for the average belt position in the −direction.

In comparison, referring to FIG. 9(*b*), in a case where the first and second steering rollers 34 and 35 are tilted in the opposite phase from the above described one (that is, first steering roller 34 is tilted in +ST1 direction, and second steering roller 35 is tilted in −ST2), the direction of the change in the position of the intermediary transfer belt 31 in terms of its widthwise direction, which occurs on the first steering roller 34 is the +Y1 direction (rearward direction). In this case, the direction of the change in the position of the intermediary transfer belt 31 in terms of its widthwise direction, which occurs on the second steering roller 35, is also the +Y2 direction (also, rearward direction). That is, the changes in the position of the intermediary transfer belt 31 in terms of its widthwise direction which occur on the first steering roller 34, and those on the second steering roller 35, are the same in direction. In this case, compensation is made for the average belt position in the +direction.

Figure 10:
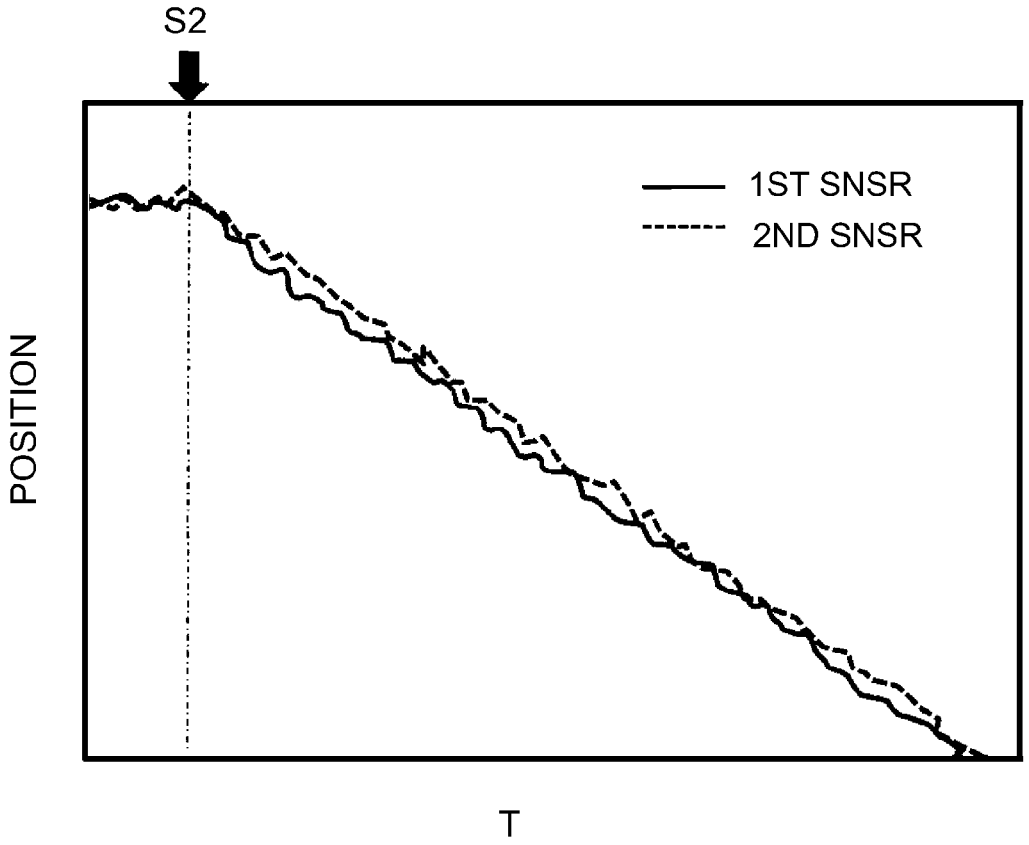
FIG. 10 is a graph which shows the changes in the position of the belt, in terms of the widthwise direction, which occurred as two steering rollers were simultaneously tilted in the opposite direction relative to each other, and which were detected by the first and second sensors.

FIG. 10 shows the changes in the position of the intermediary transfer belt 31 in its widthwise direction, which occur when the first and second steering rollers 34 and 35 are tilted in steps in the −ST direction, and +ST direction, respectively, as shown in FIG. 9(*a*). The timing with which the steering rollers 34 and 35 are tilted in steps is the timing S2 in FIG. 10. It is evident from FIG. 10 that both the first and second sensors 38*a* and 38*b* displaced in the −direction, and the average belt position changed in the −direction. Further, both plots in FIG. 10 overlap with each other, indicating that both the belt edge, the position of which is detected by the first sensor 38*a*, and the belt edge, the position of which is detected by the second sensor 38*b*, moved in the −direction. That is, this control has virtually no effect upon the angle of the intermediary transfer belt 31, because the changes in the position of the intermediary transfer belt 31 in terms of its widthwise direction, which occur on the first steering roller 34, and those on the second steering roller 35, are the same in direction, and also, the amount by which the intermediary transfer belt 31 is laterally moved relative to the primary transfer surface H by the first steering roller 34, and the amount by which the intermediary transfer belt 31 is moved relative to the primary transfer surface H by the second steering roller 35 are roughly the same.

The tilting of the first steering roller 34, and the tilting of the second steering roller 35, which are different in direction, are used as the actuator for controlling the feed back control system which compensates for the average belt position by determining the average belt position. Therefore, it is possible to control the average position without affecting the belt angle.

6-3. Compensation for Angular Belt Deviation and Lateral Belt Deviation

Next, it is assumed that the intermediary transfer belt 31 is deviant from target values in both its angle and average position. In this case, the operation for compensating for the angular belt deviation, and the operation for compensating for the lateral belt deviation, are carried out at the same time. Incidentally, it is assumed here that the system is linear in characteristic, and therefore, two operations can be carried out at the same time.

The amount of the control command for the first steering motor 108*a* when compensation is made for both the lateral belt deviation and angular belt deviation at the same time is the sum of the following control command signals obtained by the adder 83. The first is the control command signal (first angle control command signal) outputted from the belt angle control device C1, based on the detected amount of angular deviation, to control the first steering roller 34 in angle. The second is the control command signal (first position command value) outputted from the average belt position control device C2 based on the average belt position to control the first steering roller 34 to compensate for the average belt position.

Further, the amount of control command for controlling the second steering motor 108*b* when compensation is made for both the angular belt deviation and lateral belt deviation at the same time, is the sum of the following control signals obtained by the adder 84. The first is the control command signal outputted from the belt angle control device C1 based on the detected amount of angular belt deviation to control the first steering roller 35 in angle. The second is the control command signal (second position command value) outputted from the average belt position control device C2 based on the detected average belt position to control the second steering roller 35 to control the intermediary transfer belt 31 in average position.

This is how the intermediary transfer belt 31 can be compensated for its angular deviation and lateral deviation.

6-4. Effects of Angular Belt Deviation and Lateral Belt Deviation

At this time, the effects of the angular belt deviation and lateral belt deviation upon the color deviation which might occur during a printing operation are discussed.

If the intermediary transfer belt 31 is deviant in angle from the target value, it results in color deviation. Thus, it is desired that the angular belt deviation relative to the target value is as close as possible to zero. In other words, in order to minimize color deviation, it is highly important to strictly control the belt angle in terms of absolute value. On the other hand, the lateral belt deviation has little effect upon color deviation, as long as the intermediary transfer belt 31 does not change in the average position while a given point of the intermediary transfer belt 31 is conveyed from the primary transferring portion T1Y of the image forming apparatus 20Y, or the most upstream image forming apparatus 20, to the primary transferring portion T1K of the image forming apparatus 20K, or the most downstream image forming portion 20. Therefore, need to strictly control the intermediary transfer belt 31 in position (absolute value of target value for average belt position) in terms of its widthwise direction is relatively low, as long as the intermediary transfer belt 31 does not deviate all the way to the lengthwise end of the belt supporting roller(s). Further, it is possible that if compensation is too quickly and excessively made for the lateral belt deviation, the compensatory operation itself will result in color deviation, in a case where the intermediary transfer belt 31 is suddenly changed in average position by the separating operation or contacting operation. Therefore, in order to minimize color deviation, it is desired that the control gain for compensating for the angular belt deviation is made as large as possible, whereas the control gain for compensating for the lateral belt deviation is made as small as possible within the range in which it is possible to prevent such problems that the intermediary transfer belt 31 is made by external disturbance or the like to displace itself all the way to the edge of the belt supporting roller(s), and/or excessively change in position.

An image forming apparatus is desired to output images which are virtually free of color deviation during a printing operation, and also, to be short in the length of time from when an operator gives a print start signal to when images begin to be outputted. Thus, it is necessary for the belt angle and average belt position will have reached their target values during the period between when the operator gives a print start signal and when the image forming apparatus begin to output images. In order to shorten the length of time between inputting of a print start signal by an operator to the outputting of images by the image forming apparatus, it is desired that the belt angle reaches the target value as fast as possible. In this chain of thought, it is effective to increase the control gain for the belt angle compensation. Further, in order to minimize the amount by which the intermediary transfer belt 31 has to be laterally moved for the compensation for the lateral belt deviation during a printing operation, it is effective to change the target value (target average position) for the average belt position, to the current average belt position, with such a timing that the belt conveyance speed becomes stable after the intermediary transfer belt 31 begins to be conveyed. Setting the target average belt position value (target average position) to the current average belt position makes it unnecessary to substantially change the average belt position to compensate for the lateral belt deviation. Therefore, it becomes possible to make the average belt position to quickly reach its target value to minimize the intermediary transfer belt 31 in lateral deviation. Thus, it becomes possible to reduce the length of time between when an operator inputs a print start command and when images begin to be outputted.

Further, the target average belt position can be changed to a position (normally, center value of belt in its widthwise direction), where it does not occur that the intermediary transfer belt 31 laterally deviates all the way to the edge of the belt supporting roller(s), at a speed permissible from the standpoint of preventing color deviation, after the target average position is changed to such a value as the value of the average belt position immediately after the intermediary transfer belt 31 became stable in conveyance speed. Therefore, it is possible to accomplish all of the objective of minimizing the length of time it takes for an image forming apparatus to output images after the inputting of a print start signal, the reduction in the color deviation attributable to the sudden change in the belt position in terms of the widthwise direction of the belt, and the objective of preventing the belt from laterally deviating all the way to the lengthwise end of the belt supporting roller(s). In this case, the speed with which the above described target average belt position is changed can be set as the speed which does not cause color deviation, to the following value(s). More specifically, the change in the position of the intermediary transfer belt 31 in its widthwise direction, which occurs while a given point of the intermediary transfer belt 31 moves between the adjacent image forming means (for example, between the primary transferring portions T1Y and T1K of the image forming portion 20Y and 20K, respectively), results in color deviation. Therefore, the speed with which the above described target average belt position is changed has only to be set so that the color deviation which occurs during this period can be kept at a target level or less.

6-5. Control Flow

Figure 11:
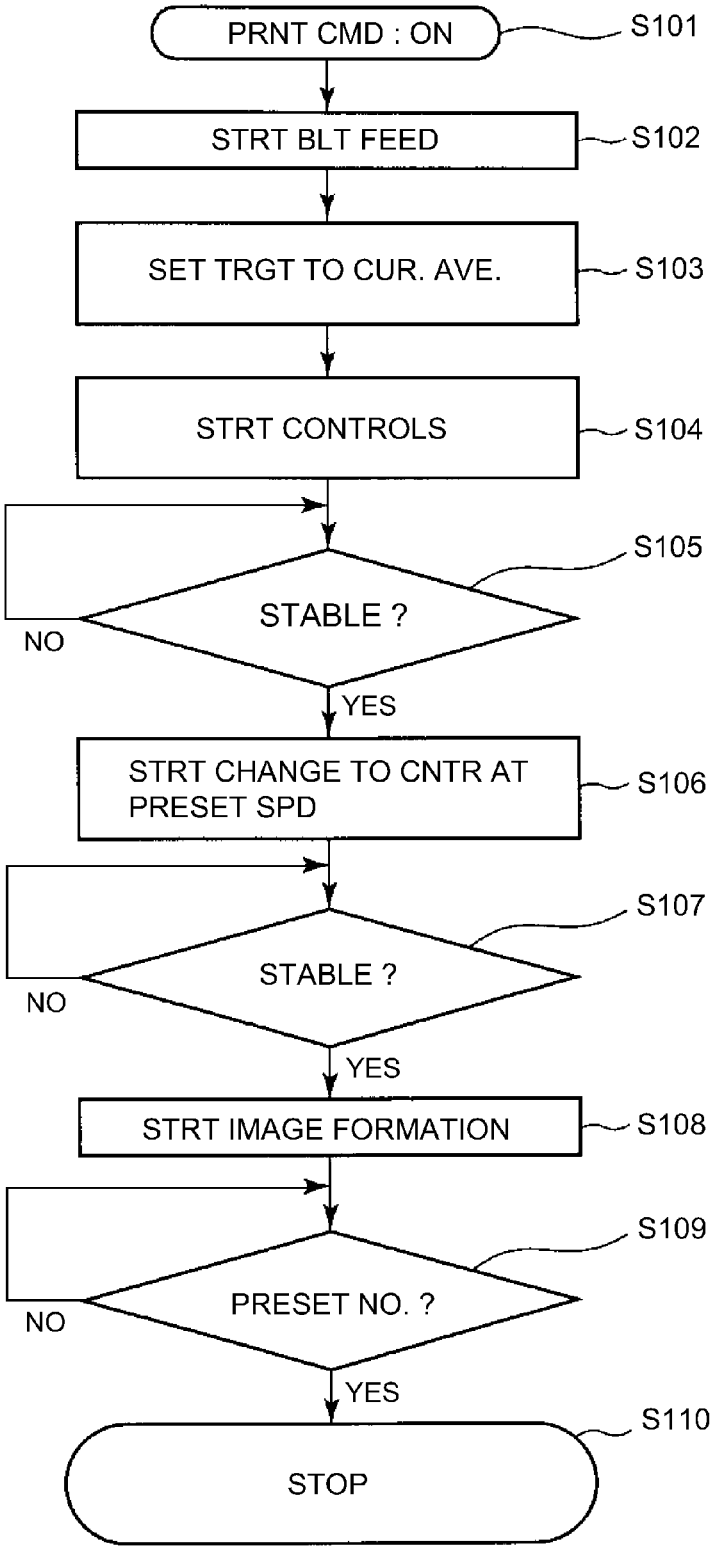
FIG. 11 is a flowchart of the steering control sequence in the first embodiment, showing from the starting to the end of a printing operation.

FIG. 11 is a flowchart of the general operational sequence of an image forming operation. It shows the portion of the image formation sequence from when a print start command is inputted by an operator to when a printing operation ends.

First, a print start command is inputted by an operator (S101). As the operation for conveying the intermediary transfer belt 31 is started (S102), the target average belt position is changed to the current average position (S103), whereby the amount by which the intermediary transfer belt 31 is to be changed in position in terms of its widthwise direction can be minimized, and therefore, image formation can be started sooner.

Next, both the operation for compensating for the lateral belt deviation, and the operation for compensating for the angular belt deviation, can be started at the same time (S104). These operations are continued until the average belt position becomes stable at the target average belt position (S105). As soon as the average belt position becomes stable at the target average belt position, the control for changing the target average belt position to the center value of the intermediary transfer belt 31 suspension, at a preset speed, is started (S106). Here, regarding the preset speed, it is desired to be set to a value which is small enough not to make intolerably conspicuous the color deviation attributable to the change in the position of the intermediary transfer belt 31 in terms of its widthwise direction.

Next, until the belt angle becomes stable at a target value, the image formation is not started in any of the image forming portions 20, and the operation for compensating for the angular belt deviation, and the operation for compensating for the lateral belt deviation are continued (S107). As soon as the belt angle becomes stable at a target value, image formation is started in the image forming portions 20 (S108). By the way, it may be before the starting of image formation or during image formation that the target average belt position reaches the center value.

As soon as images are formed on a preset number of sheets of transfer medium (S109), the printing operation is ended (S110). At the end of the printing operation, the conveyance of the intermediary transfer belt 31 is stopped, and the operation for controlling the intermediary transfer belt 31 in average position, and the operation for controlling the intermediary transfer belt 31 in angle, are stopped.

In this embodiment, the operations carried out by various portions of the image forming apparatus 1 are integrally controlled by the control portion 10 (FIG. 1) of the image forming apparatus 1. The control portion 10 has: a CPU as a computation controlling means; and memories (storage medium) such as RAM and ROM as storing means. It controls the operational sequence of each of various portions of the image forming apparatus 1, according to the programs and data stored in the memories. For example, the control portion 10 activates the tilt control unit 100, etc., with a preset timing to carry out the printing operation job (image forming operation to be started by print start signal to form an image on single or multiple sheets of transfer medium) from the beginning to the end.

Typically, the first and second steering rollers 34 and 35 are roughly the same in the absolute value (angle) of the angle b which they are simultaneously tilted in the same or opposite direction. However, in a case where the first and second steering rollers 34 and 35 are different in diameter and/or angle by which the intermediary transfer belt 31 wraps around them, and/or in the case of a steering mechanism which can steer the intermediary transfer belt 31 in parallel and/or perpendicular to the primary transfer surface H, even if the first and second steering rollers 34 and 35 are tilted by the same angle, the speed with which the intermediary transfer belt 31 is made to laterally shift by the first steering roller 34 and that by the second steering roller 35 sometimes do not become the same. Therefore, in a case where the two steering rollers 34 and 35 are tilted in the same direction and by the same angle, it sometimes occurs that not only the intermediary transfer belt 31 changes in angle, but also, lateral shift destination. Further, even if the two steering rollers 34 and 35 are tilted in the opposite direction by the same angle, it sometimes occur that the intermediary transfer belt 31 changes not only in its lateral shift destination, but also, angle, for the reasons given above.

Therefore, in a case where the first and second steering rollers 34 and 35 are different in diameter and/or angle of contact, and/or in the case of a steering mechanism which is capable of tilting the steering rollers 34 and 35 in parallel to the primary transfer surface H, they may be structured, as shown in FIG. 6, so that before a command to begin driving the first and second steering rollers 34 and 35 is given, control gains b1 and b2, which are for balancing the first steering roller 34 and second steering roller 35 in lateral belt shift speed, are given. That is, the control unit 10 may be structured so that one or both of the first and second steering rollers 34 and 35 are weighted in the absolute value of the angle by which they are tilted.

Here, the lateral belt shift speed is generated as the point at which the intermediary transfer belt 31 begins to wrap around a steering roller (34 or 35), and the point at which the intermediary transfer belt 31 separates from the steering roller (34 or 35) become different in terms of the direction parallel to the axial line of the steering roller. Therefore, compensation can be made using the inverse number of the ratio between the lateral shift speed of the first steering roller 34 and that of the second steering roller 35 when the two steering rollers 34 and 35 are set at the same in angle. Therefore, even if the belt unit 30 is such that its first and second steering rollers 34 and 35 are different in the lateral belt shift speed when the two rollers 34 and 35 are the same in angle of tilt, compensation can be highly precisely made for both the angular and lateral deviation of its intermediary transfer belt, for the following reason. That is, the speed with which the intermediary transfer belt 31 is laterally shifted by the first steering roller 34 in one direction, and the speed with which the intermediary transfer belt 31 is laterally shift by the second steering roller 35 in opposite direction, in order to compensate for the angular belt deviation, can be made permissibly close to each other.

As described above, the belt driving device 30 in this embodiment has the first and second steering rollers 34 and 35, which are on the upstream and downstream sides of the image receiving surface (primary transfer surface) H, in terms of the belt conveyance direction, by which the intermediary transfer belt 31 receives images. The first sensor 38*a* is for changing the intermediary transfer belt 31 in position in terms of the direction intersectional (roughly perpendicular, in this embodiment) to the belt conveyance direction. Further, the belt driving device 30 has the tilting means for separately tilting the first and second steering rollers 34 and 35. In this embodiment, the tilting means is made up of the tilt control unit 100, and blocks 80-86, C1, C2, b1, b2, etc. Further, the belt driving device 30 has the first detecting means (which hereafter may be referred to as "belt angle detecting means") for detecting the belt angle relative to the normal belt conveyance direction. In this embodiment, the belt angle detecting means is made up of the first sensor 38*a*, second sensor 38*b*, substracter 85, etc. Further, the belt driving device 30 has the second detecting means (which hereafter may be referred to as "belt position detecting means") for detecting the belt position in terms of the direction perpendicular to the belt conveyance direction. In this embodiment, the belt position detecting means is made up of the first sensor 38*a*, second sensor 38*b*, adder 86, etc. The tiling means tilts the first steering roller 34, based on the sum of the control amounts. The first one is the control amount for tilting the first steering roller 34, based on the results of the detection by the belt angle detecting means, so that the first and second steering rollers 34 and 35 simultaneously tilt in the same direction. The second one is the control amount for tilting the first steering roller 34 based on the results of detection by the belt position detecting means, so that the first and second steering rollers 34 and 35 simultaneously tilt in the opposite direction relative to each other. Further, the tilting means tilts the second steering roller 35, based on the results of the addition of the following control amounts. The first one is the control amount for tilting the second steering roller 35, based on the results of detection by the belt angle detecting means, so that the first and second steering rollers 34 and 35 simultaneously tilt in the same direction. The next one is the control amount for tilting the second steering roller 35, based on the results of detection by belt position detecting means, so that the first and second steering rollers 34 and 35 simultaneously tilt in the opposite direction relative to each other.

In this embodiment, the control gain based on the results of detection by the belt angle detecting means can be made greater than the control gain based on the results of detection by the belt position detecting means. Further, the belt driving device 30 may have a means which sets a target value for the results of detection by the belt position detecting means, to control the operation for tilting the first and second steering rollers 34 and 35 with the use of the tilting means. In this embodiment, the target value setting means is made up of the control portion 10, etc. Further, this target value setting means sets the position (value) of the intermediary transfer belt 31 detected by the belt position detecting means after the intermediary transfer belt 31 began to be conveyed and became stable in conveyance speed, as the initial position (value) for the target value. Further, the target value setting means is provided with a referential value which corresponds to the referential belt position in terms of the direction perpendicular to the belt conveyance direction. The target value setting means can change the target value from the above described initial value to the above described referential value, at a preset rate.

Typically, the tilting means makes the first and second steering rollers 34 and 35 roughly the same in the absolute value of the angles by which they are tilted, as described above. However, the tilting means can be weighted in terms of the absolute value of the angles by which the first steering roller 34 and/or second steering roller 35 is tilted, as described above. Therefore, it is possible to make roughly the same the speed with which the intermediary transfer belt 31 is moved in the direction intersectional to the belt conveyance direction, by the tilting of the first steering roller 34, and the speed with which the intermediary transfer belt 31 is moved in the direction intersectional to the belt conveyance direction, by the tilting of the second steering roller 35, as described above. That is, simultaneously tilting the first and second steering rollers 34 and 35 in the same direction includes not only simultaneously tilting the first and second steering rollers 34 and 35 in the same direction by roughly the same angle in terms of absolute value, and also, simultaneously tilting them in the same direction by weighted angles in terms of absolute value. Similarly, simultaneously tilting the first and second steering rollers 34 and 35 in the opposite direction includes not only simultaneously tilting them in the opposite direction by roughly the same angle in terms of absolute value, but also, simultaneously tilting them in the opposite direction by the weighted angles in terms of absolute value.

To describe in further detail, in this embodiment, the tilting means is provided with controlling devices (C1, C2, etc.) which generate the following command values. The first is the first belt angle command value which is for tilting the first steering roller 34 based on the result of the detection by the belt angle detecting means. The next is the second belt angle command value which is for tilting the second steering roller 35 based on the result of the detection by the belt angle detecting means. The next is the first belt position command value which is for tilting the first steering roller 34 based on the results of the detection by the belt position detecting means. The next is the second belt position command value which is for tilting the second steering roller 35 based on the result of the detection by the belt position detecting means. In this case, the tilting means has the first adder 83 which adds the first position command value and the first belt angle command value, and the second adder 84 which adds the second position command value and the second belt angle command value. Further, the tilting means has the first driving means 108 which tilts the first steering roller 34 in response to the output of the first adder 83, and the second driving means 108*b* which tilts the second steering roller 35 in response to the output of the second adder 84.

7. Comparison with Comparative Control

Next, the control in this embodiment is compared with a comparative control. A comparative image forming apparatus and its belt unit are practically the same in structure as those in this embodiment shown in FIG. 1. However, the former is different from the latter in the control of the operation for compensating for the angular and lateral deviations of its intermediary transfer belt 31.

Figure 12:
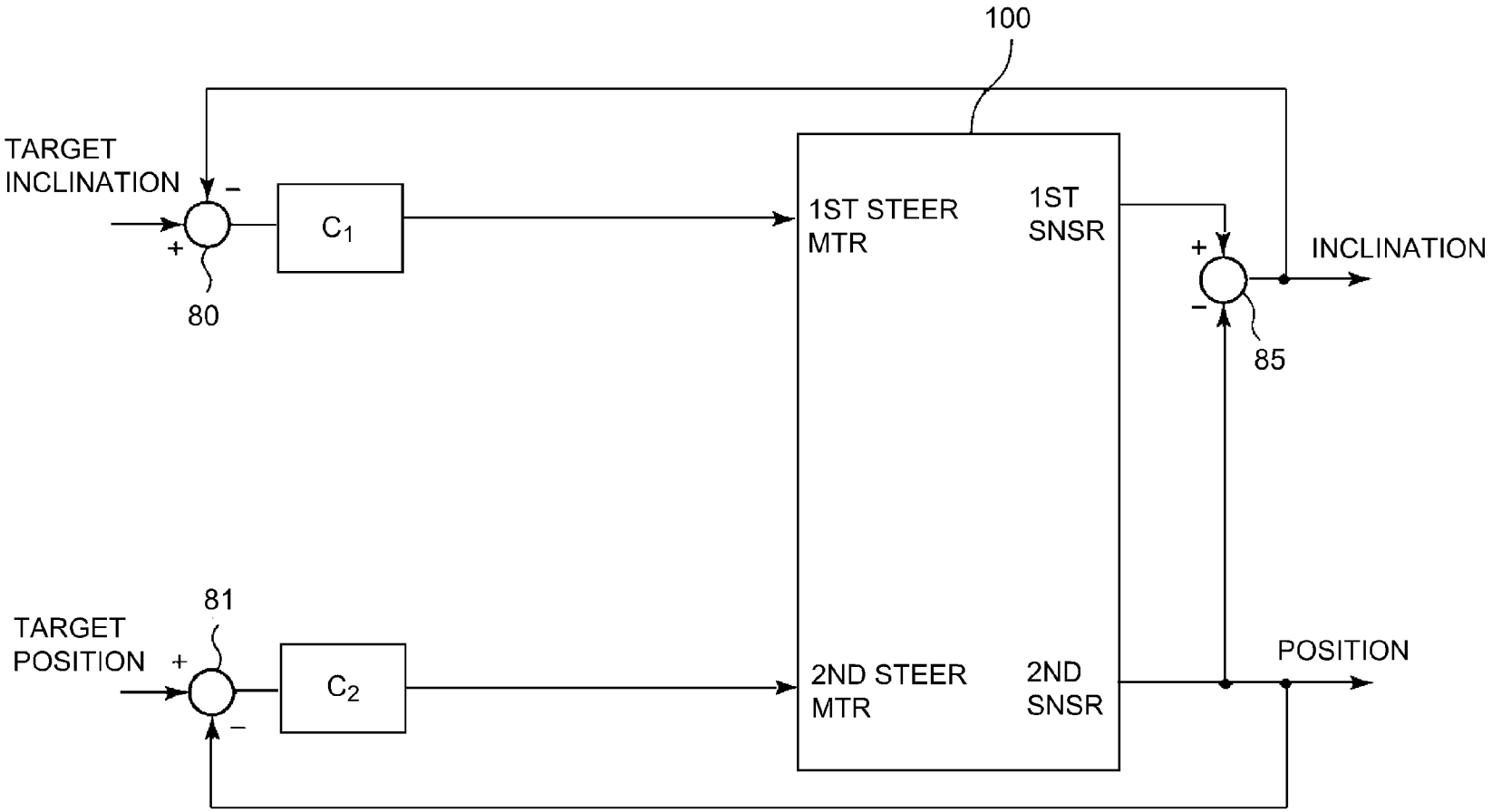
FIG. 12 is a block diagram of a comparative example of steering control.

FIG. 12 is a block diagram of the comparative control sequence for compensating for the angular belt deviation and lateral belt deviation. In the case of the comparative control, one (first steering roller 34) of the two steering rollers is driven based on the amount of the angular belt deviation, and, the other steering roller (second steering roller 35) is driven based on the amount of the lateral belt deviation.

Figure 13:
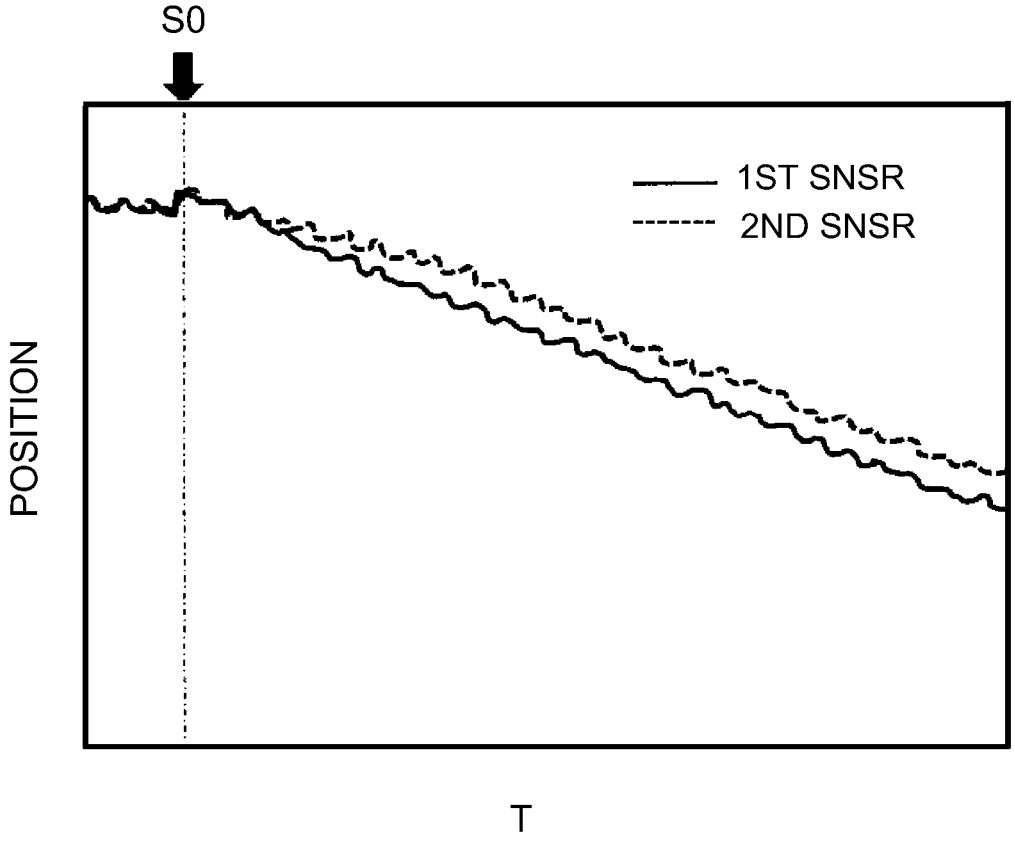
FIG. 13 is a graph which shows the changes in the belt position in terms of its widthwise direction, which occurred when a single steering roller was tilted by the comparative example of steering control, and which were detected by the first and second sensors.

The characteristics of the comparative corrective operation are as follows: Shown in FIG. 13 are the changes in the belt position detected by the first sensor 38*a* and second sensor 38*b* when the first steering roller 34 was tilted in steps in the +direction (+ST1). The timing with which the first steering roller 34 began to be tilted in steps is a point S0 in FIG. 13. Referring to FIG. 13, the belt position detected by the first sensor 38*a* and that detected by the second sensor 38*b* gradually changed in the −direction while increasing in the difference in the amount of lateral shift between the belt positions detected by the first and second sensors 38*a* and 38*b*, respectively. Thus, it is evident that in a case where only one steering roller is used to tilt the intermediary transfer belt 31, the change in the average belt position and the change in the belt angle occurs at the same. Therefore, in a case where the tilting of a single steering roller is used as an actuator for the control for compensating for the angular belt deviation or lateral belt deviation, the following occurs. That is, the belt unit 30 becomes such a system that compensating for the angular belt deviation disturbs the belt unit 30 in terms of the belt position (comparison with FIG. 8), whereas compensating for lateral belt deviation disturbs the belt unit 30 in belt angle (comparison with FIG. 10). Therefore, it becomes difficult to precisely compensate for the angular belt deviation and/or lateral belt deviation.

Next, a case in which it is attempted to increase in gain the operation for compensating for the angular belt deviation in order to reduce an image forming apparatus in color deviation is discussed. In this case, increasing in gain the operation for compensating for the angular belt deviation increases the belt unit 30 not only in the performance to compensate for the angular belt deviation, but also, the amount by which the belt unit 30 is disturbed in belt position. Therefore, it possibly causes the intermediary transfer belt 31 to laterally shift all the way to the end of the belt supporting roller(s), and/or the operation will fail. In reality, therefore, it is impossible to increase in gain the operation for compensating for the angular belt deviation as much as necessary. In other words, in the case of the comparative operation, it is difficult to improve the belt unit 30 in the performance to compensate for the angular belt deviation. In comparison, in the case of the control in this embodiment, compensation for the angular belt deviation is made by tilting two steering rollers. Therefor, the compensation can be made without disturbing the intermediary transfer belt in position in terms of its widthwise direction. Therefore, even if the operation for compensating for the angular belt deviation is substantially increased in control gain, it does not cause the belt to lateral shift all the way to the lengthwise end of the belt supporting roller(s), nor to cause the operation to fail, by its interaction with the operation for compensating for the angular belt deviation. Therefore, it can be made substantially greater in control gain, compared to the comparative operation. That is, the operation, in this embodiment, for compensating for the angular belt deviation is greater in performance than the comparative one. Therefore, the employment of the control in this embodiment can substantially reduce an image forming apparatus in the length of time it takes for the apparatus to begin image formation after the inputting of a print start signal, compared to the comparative operation, and also, can prevent color deviation.

Next, the comparative operation is described regarding a case in which in order to reduce the length of time it takes for image formation to be started after a printing start command is given, the target average belt position is changed to the current belt position, with the timing with which the belt becomes stable in conveyance speed after the belt begins to be conveyed. In this case, as the target average belt position is changed, the belt is corrected (changed) in position based on the new target average belt position. In the case of the comparative control operation, however, the belt is affected in angle. That is, it does not occur that compensation is made for only the lateral belt deviation as intended. Therefore, even if the average target position is slowly changed in order not to cause the color deviation attributable to the change in belt position, the belt unit is affected in belt angle which has direct effect upon color deviation. Therefore, the change in the target average belt position results in the occurrence of color deviation. In comparison, in the case of the control in this embodiment, it is possible to compensate for the lateral belt deviation, based on the information regarding the belt position, without affecting the belt angle. Therefore, it does not cause problems such as those described above. In other words, by changing the target average belt position with the use of the control in this embodiment, it becomes possible to reduce the length of time it takes for image formation to be started after a print start command is given, without negatively affecting an image forming apparatus in terms of the color of a full-color image.

Embodiment 2

Next, another embodiment of the present invention is described. The belt driving device and image forming apparatus in this embodiment are basically the same in structure as those in the first embodiment. Therefore, the components of the belt driving device and image forming apparatus in this embodiment, which are the same as, or equivalent to, the counterparts in the first embodiment, in function and structure, are given the same referential codes as those given to the counterparts, and are not described in detail.

For example, if the two steering rollers are different in the material of their surface layer, they become different in the manner in which a belt slides on a roller. Thus, it sometimes occurs that the two steering rollers temporarily become different in properties, and/or the change in the alignment of the intermediary transfer belt affects only one of the two steering rollers. In such a case, there occurs sometimes a cross-talk between the compensation for the angular belt deviation and the compensation for the lateral belt deviation.

In a case where there is cross-talk between the compensation for the angular belt deviation and the compensation for the lateral belt deviation, it is effective to alternately and independently carry out the operation for compensating for the angular belt deviation by simultaneously tilting the first and second steering rollers 34 and 35 in the same direction, based on the amount of the angular belt deviation, and the operation for compensating for the lateral belt deviation by simultaneously tilting the first and second steering rollers 34 and 35 in the opposite direction, based on the detected belt position.

By independently and alternately carrying out the operation for compensating for the angular belt deviation and the operation for compensating for the lateral belt deviation, it is possible to highly precisely compensate for the angular belt deviation and lateral belt deviation while minimizing the possibility that the control is nullified by the cross-talk.

Figure 14:
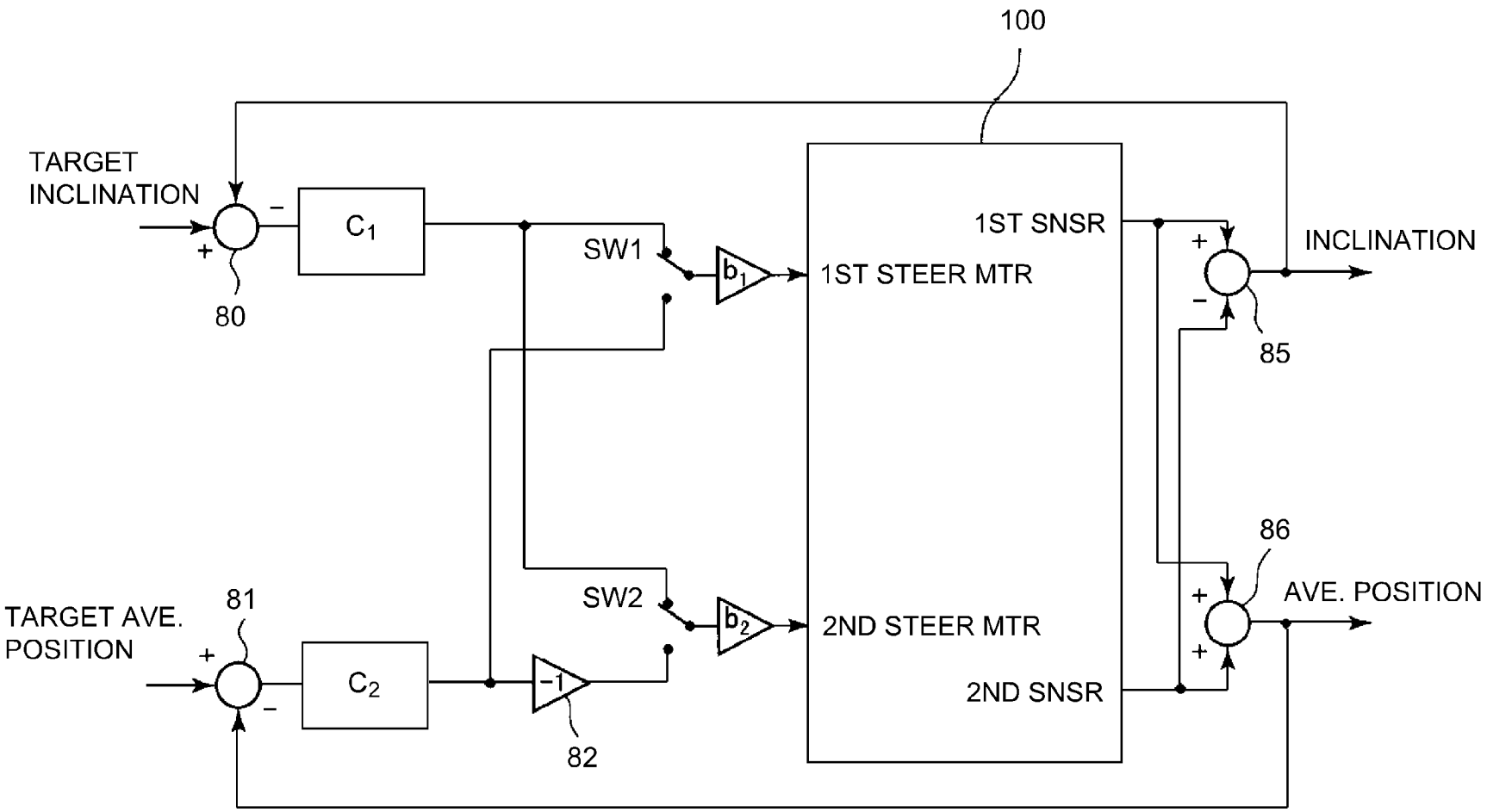
FIG. 14 is a block diagram of the steering control sequence in another (second) embodiment of the present invention.

FIG. 14 is a block diagram of the control sequence in this embodiment, for compensating for the angular belt deviation and lateral belt deviation. Each of the operation for compensating for the angular belt deviation, and the operation for compensating for the lateral belt deviation, is the same as the counterpart in the first embodiment. However, this embodiment is different from the first embodiment in that in this embodiment, switches SW1 and SW2 are provided in place of the adders 83 and 84, in the first embodiment, for adding the control commands.

When it is necessary to compensate for only the angular belt deviation, both the switches SW1 and SW2 are flipped upward in FIG. 14 (side which connects belt angle controlling devices C1 to first and second steering motors 108*a* and 108*b* (or control gains b1 and b2). On the other hand, when it is necessary to compensate for only the lateral belt deviation, both the switches WW1 and SW2 are flipped downward in FIG. 14 (side which connects average belt position controlling device C2 to first and second steering motor 108*a* and 108*b* or control gains b1 and b2).

In other words, this embodiment makes it possible to select the control command for the belt angle compensation, or the control command for the belt position compensation, in order to selectively carry out the operation for compensating for the angular belt deviation, or the operation for compensating for the lateral belt deviation, respectively.

Figure 15:
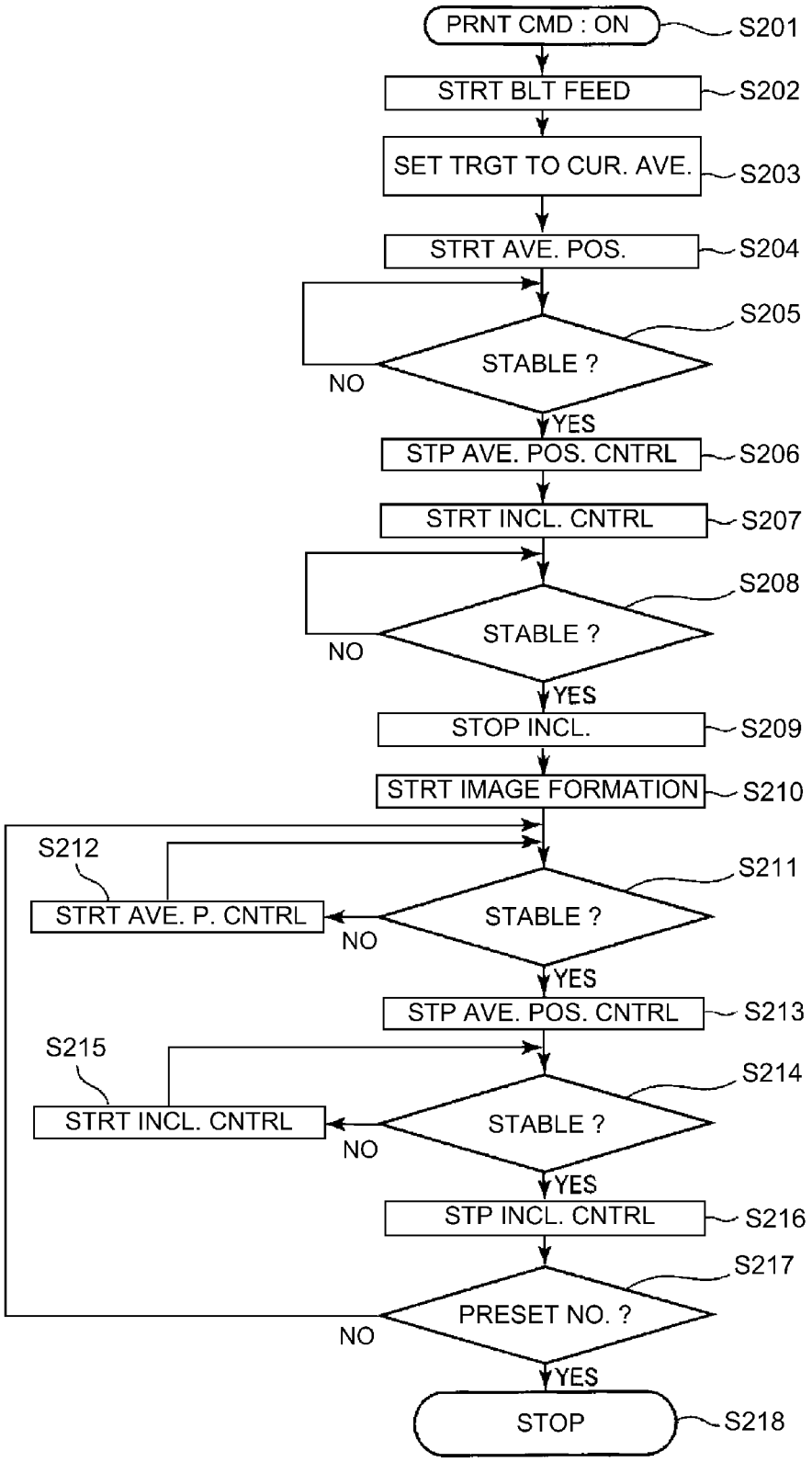
FIG. 15 is a flowchart of the steering control sequence in the second embodiment, showing from the beginning to the end of a printing operation.

FIG. 15 is a flowchart of the general operational sequence from when a print start command is given by an operator, to when the printing operation ends.

A print start command is given by an operator (S201). As the intermediary transfer belt 31 begins to be conveyed (S202), first, the target average belt position is changed to the value of the current average belt position (S203), whereby it becomes possible to minimize the amount by which the belt has to be changed in position, and therefore, it is possible to reduce the length of time it takes for the image forming apparatus to start forming images after the print start command is given.

Next, only the operation for compensating for only the lateral belt deviation is started (S204). By the way, in the operation for compensating for only the lateral belt deviation, the control which changes, at a preset speed, the target average belt position to the center value of the suspension of the intermediary transfer belt 31 is also carried out. This operation is continuously carried out until the average belt position settles at the target average belt position (S205). As soon as the average belt position settles at the target value, the operation for compensating for the lateral belt deviation is stopped (S206), and the operation for compensating for only the angular belt deviation is started (S207). This operation is continued alone until the belt angle settles at the target angle (S208). As soon as the belt angle settles at the target angle, the operation for compensating for only the angular belt deviation is ended (S209), and image formation is started in the image forming portions 20 (S210).

Even during an image forming operation, the operation for determining whether or not the belt position is stable at the average target position (S211), and the operation for determining whether or not the belt angle is stable as the target angle (S214), are alternately repeated. If it is determined that the belt unit is not stable in the belt angle, or belt position, the operation for compensating for the lateral belt deviation, and the operation for compensating for the angular belt deviation are carried out (combination of S212 and S213, and combination of S215 and S216).

As soon as the image forming operation is carried out for a preset number of sheets of transfer medium (S217), the printing operation is ended (S218). When the printing operation is ended, the conveyance of the intermediary transfer belt 31 is also ended.

By independently and alternately carrying out the operation for compensating for the angular belt deviation, and the operation for compensating for the lateral belt deviation, it is possible to highly precisely compensate for the angular belt deviation and lateral belt deviation, while minimizing the possibility that the belt control is nullified by cross-talk, even if there is cross-talk. Further, because it is possible to highly precisely compensating for the angular belt deviation and lateral belt deviation, it is possible to reduce the length of time it takes for an image forming apparatus to start image formation after a print start command is given, and also, to prevent the apparatus from outputting images suffering from color deviation.

As described above, the tilting means can alternately carry out the operation for simultaneously tilting the first and second steering rollers 34 and 35 in the same direction, based on the result of the detection by the belt angle detecting means, and the operation for simultaneously tilting the first and second steering rollers 34 and 35 in the opposite direction, based on the result of the detection by the belt position detecting means. In this case, the tilting means is provided with controlling devices (C1, C2, or the like) which generate the belt angle command value and belt position command value, and a selecting devices (SW1, SW2, or the like) for selecting one of the belt angle command value and belt position command value, respectively. Also in this case, the tilting means is provided with first and second driving means 108*a* and 108*b* for tilting the first and second steering rollers 34 and 35, respectively, in response to the belt angle command value or belt position command value, which is selected by the selecting device.

Miscellaneous

In the foregoing, the present invention was described with reference to concrete embodiments of the present invention. However, these embodiments are not intended to limit the present invention in scope.

According to the present invention, the two steering rollers are simultaneously tilted in the same direction, based on the information regarding the belt angle, in order to compensate for the angular belt deviation, or the two steering rollers are simultaneously tilted in the opposite direction, based on the information regarding the belt position, in order to compensate for the lateral belt deviation. In this context, the present invention can be embodied in the form of a belt driving device, and also, an image forming apparatus, which are entirely or partially different in structure from those in the preceding embodiments. In other words, the present invention is compatible with any belt driving device which employs an endless belt, whether the belt is used as an intermediary transfer belt (intermediary transferring member), a transfer medium conveying belt (transfer medium bearing member), a transfer belt (transferring member), a photosensitive belt (image bearing member), or the like. Further, the present invention is also compatible with any image forming apparatus which employs an endless belt which is steered with steering rollers, whether the apparatus is of the tandem/singe drum type, or intermediary transfer/transfer medium conveyance type. In the description of the preceding embodiments of the present invention, only the portions of the image forming apparatus, which are related to the formation of a toner image, and the transfer of the toner image, were described. However, the present invention is applicable to various image forming apparatuses such as printers, copying machines, faxes, multifunction image forming apparatuses, etc., which are combinations of the above described portion, and additional devices, equipments, casing, etc. Further, the above described embodiments are not intended to limit the present invention in the number of image forming portions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 127991/2013 filed Jun. 18, 2013, which is hereby incorporated by reference.

What is claimed is:

1. A belt driving device for driving an endless belt, the belt driving device comprising:

a plurality of rollers configured to stretch the belt, said rollers including first and second steering rollers being provided in an upstream side and a downstream side of an image receiving surface of the belt for receiving an image, respectively, and being configured to change a position of the belt in a direction crossing with a moving direction of the belt by inclining respectively;

first and second pivoting mechanisms configured to pivot said first steering roller and second steering roller in accordance with respective pivoting instruction values;

a first detecting member and a second detecting member configured detect a position of the belt with respect to a widthwise direction crossing with a moving direction of the belt;

a first setting portion configured to set a first pivoting instruction value and a second pivoting instruction value through which said first steering roller and said second steering roller are pivoted in the same direction, respectively, on the basis of results of detections of said first detecting member and second detecting member;

a second setting portion configured to set a third pivoting instruction value and a fourth pivoting instruction value through which said first steering roller and said second steering roller are pivoted in the opposite directions, respectively, on the basis of a result of detection of at least one of said first detecting member and second detecting member; and a controller configured to pivot said first steering roller by said first pivoting mechanism on the basis of an addition value of the first pivoting instruction value and the third pivoting instruction value, and configured to pivot said second steering roller by said second pivoting mechanism on the basis of an addition value of the second pivoting instruction value and the fourth pivoting instruction value.

2. A belt driving device according to claim 1, wherein said controller pivots said first steering roller by said first pivoting mechanism and pivots said second steering roller by said second pivoting mechanism, alternately.

3. A belt driving device according to claim 1, wherein gains of the first pivoting instruction value and the second pivoting instruction value set by said first setting portion are larger than gains of the third pivoting instruction value and the fourth pivoting instruction value set by said second setting portion, respectively.

4. A belt driving device according to claim 1, wherein said first setting portion sets the first pivoting instruction value and the second pivoting instruction value on the basis of a difference between a target inclination value and an inclination value in the moving direction of the belt which corresponds to a difference between outputs of said first detecting member and said second detecting member, and wherein said second setting portion sets the third pivoting instruction value and the fourth pivoting instruction value on the basis of a difference between a target inclination value and an inclination value in the moving direction of the belt which corresponds to a difference between output of at least one of said first detecting member and said second detecting member.

5. A belt driving device according to claim 1, wherein said first setting portion and said second setting portion set the first pivoting instruction value and the third pivoting instruction value such that absolute values of them are substantially the same, and such that absolute values of the second pivoting instruction value and the fourth pivoting instruction value are substantially the same.

6. A belt driving device according to claim 1, wherein said first setting portion weights an absolute value of the first pivoting instruction value and an absolute value of the second pivoting instruction value, and said second setting portion weights an absolute value of the third pivoting instruction value and an absolute value of the fourth pivoting instruction value, and by these weightings, a moving speed of the belt in the widthwise direction by the pivoting of said first steering roller and a moving speed of the belt in the widthwise direction by the pivoting of said second steering roller are substantially the same.

7. A belt driving device according to claim 1, wherein the belt is an intermediary transfer member onto which different color toner images are sequentially transferred and overlaid, or a transfer material carrying member configured to feed a transfer material onto which different color tone images are sequentially transferred and overlaid.

8. An image forming apparatus comprising the belt and the belt driving device according to claim 1.

* * * * *